US012324966B2

(12) United States Patent
Mata et al.

(10) Patent No.: US 12,324,966 B2
(45) Date of Patent: Jun. 10, 2025

(54) GOLF CLUB HEADS

(71) Applicant: Taylor Made Golf Company, Inc., Carlsbad, CA (US)

(72) Inventors: Jason Andrew Mata, Carlsbad, CA (US); Joe Hoffman, Carlsbad, CA (US); Brad Poston, San Diego, CA (US); Matthew David Johnson, San Diego, CA (US); Mark Vincent Greaney, Vista, CA (US); Justin David Kleinert, San Clemente, CA (US); Joseph Reeve Nielson, Vista, CA (US); Christopher John Harbert, Carlsbad, CA (US); Nathan T. Sargent, Oceanside, CA (US); Rachel Elizabeth Mullen, Vista, CA (US); Christian Reber Wester, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/974,279

(22) Filed: Oct. 26, 2022

(65) Prior Publication Data

US 2023/0118646 A1 Apr. 20, 2023

Related U.S. Application Data

(63) Continuation of application No. 17/233,201, filed on Apr. 16, 2021, now Pat. No. 11,541,286, which is a (Continued)

(51) Int. Cl.
*A63B 53/06* (2015.01)
*A63B 53/04* (2015.01)
(Continued)

(52) U.S. Cl.
CPC ..... *A63B 53/0466* (2013.01); *A63B 53/06* (2013.01); *A63B 60/02* (2015.10);
(Continued)

(58) Field of Classification Search
CPC . A63B 53/04; A63B 2053/0491; A63B 53/06; A63B 53/045
See application file for complete search history.

(56) References Cited

U.S. PATENT DOCUMENTS 838,284 A 12/1906 Mitchell et al.
1,133,129 A 3/1915 Govan
(Continued)

FOREIGN PATENT DOCUMENTS

JP 64043278 2/1989
JP 3725251 2/1998
(Continued)

OTHER PUBLICATIONS

Office Action from the Japanese Patent Office (English translation) for related Japanese Patent Application No. 2013-133366, 8 pages, dated Aug. 20, 2014.

*Primary Examiner* — Alvin A Hunter
(74) *Attorney, Agent, or Firm* — Klarquist Sparkman, LLP

(57) ABSTRACT

Described are embodiments of golf club heads having an internal cavity and features that cause the golf club head to have an improved acoustic performance when striking a golf ball. Some embodiments include one or more weight tracks and/or weight ports formed in the sole for receiving adjustable weights. The golf club heads can include one or more internal ribs, thickened wall regions, and/or posts positioned within the cavity that increase the rigidity of the club head and improve the acoustic performance of the club head when striking a ball.

21 Claims, 16 Drawing Sheets

Related U.S. Application Data continuation of application No. 16/415,778, filed on May 17, 2019, now Pat. No. 11,007,408, which is a continuation of application No. 15/689,759, filed on Aug. 29, 2017, now Pat. No. 10,300,356, which is a continuation of application No. 14/855,190, filed on Sep. 15, 2015, now Pat. No. 9,757,630.

(51) Int. Cl.
*A63B 60/02* (2015.01)
*A63B 60/52* (2015.01)
*A63B 60/00* (2015.01)

(52) U.S. Cl.
CPC ..... *A63B 60/52* (2015.10); *A63B 53/0408* (2020.08); *A63B 53/0416* (2020.08); *A63B 53/042* (2020.08); *A63B 53/0433* (2020.08); *A63B 53/045* (2020.08); *A63B 2053/0491* (2013.01); *A63B 60/002* (2020.08); *A63B 2209/02* (2013.01)

(56) References Cited

U.S. PATENT DOCUMENTS 1,349,806 A 8/1920 Booth
1,658,581 A 2/1928 Tobia
2,155,830 A 9/1938 Howard
3,437,133 A 4/1969 Bullard
3,608,173 A 9/1971 Watson et al.
3,652,094 A 3/1972 Glover
4,139,196 A 2/1979 Riley
4,214,754 A 7/1980 Zebelean
4,334,703 A 6/1982 Arthur et al.
4,461,479 A 7/1984 Mitchell
4,602,787 A 7/1986 Sugioka et al.
4,606,491 A 8/1986 Le Mong
4,754,974 A 7/1988 Kobayashi
4,775,156 A 10/1988 Thompson
4,795,159 A 1/1989 Nagamoto
4,811,949 A 3/1989 Kobayashi
4,877,249 A 10/1989 Thompson
4,883,274 A 11/1989 Hsien
4,895,371 A 1/1990 Bushner
4,930,781 A 6/1990 Allen
5,004,241 A 4/1991 Antonious
5,067,715 A 11/1991 Schmidt et al.
5,082,278 A 1/1992 Hsien
5,152,527 A 10/1992 Mather et al.
5,180,166 A 1/1993 Schmidt et al.
5,207,428 A 5/1993 Aizawa
5,232,224 A 8/1993 Zeider
5,273,283 A 12/1993 Bowland
5,299,807 A 4/1994 Hutin
5,316,305 A 5/1994 McCabe
5,346,217 A 9/1994 Tsuchiya et al.
5,346,218 A 9/1994 Wyte
5,419,559 A 5/1995 Melanson et al.
5,429,365 A 7/1995 McKeighen
5,464,216 A 11/1995 Hoshi et al.
5,489,097 A 2/1996 Simmons
5,497,993 A 3/1996 Shan
5,518,240 A 5/1996 Igarashi
5,533,728 A 7/1996 Pehoski et al.
5,582,553 A 12/1996 Ashcraft et al.
5,586,947 A 12/1996 Hutin
5,624,331 A 4/1997 Lo et al.
5,692,967 A 12/1997 Guyer
5,700,208 A 12/1997 Nelms
5,709,617 A 1/1998 Nishimura et al.
5,755,627 A 5/1998 Yamazaki et al.
5,766,094 A 6/1998 Mahaffey et al.
5,769,737 A 6/1998 Holladay et al.
5,772,529 A 6/1998 Ruth, Jr.
5,908,356 A 6/1999 Nagamoto
5,921,872 A 7/1999 Kobayashi
5,935,020 A 8/1999 Stites et al.
5,954,596 A 9/1999 Noble et al.
6,027,416 A 2/2000 Schmidt et al.
6,033,318 A 3/2000 Drajan, Jr. et al.
6,059,669 A 5/2000 Pearce
6,062,988 A 5/2000 Yamamoto
6,149,533 A 11/2000 Finn
6,277,032 B1 8/2001 Smith
6,299,547 B1 10/2001 Kosmatka
6,332,847 B2 12/2001 Murphy et al.
6,354,963 B1 3/2002 Kodama et al.
6,368,230 B1 4/2002 Helmstetter et al.
6,368,231 B1 4/2002 Chen
6,379,264 B1 4/2002 Forzano
6,383,090 B1 5/2002 O'Doherty et al.
6,413,168 B1 7/2002 McKendry et al.
6,435,978 B1 8/2002 Galloway et al.
6,475,100 B1 11/2002 Helmstetter et al.
6,506,128 B1 1/2003 Bloom, Jr.
6,524,197 B2 2/2003 Boone
6,558,271 B1 5/2003 Beach et al.
6,663,503 B1 12/2003 Kenmi
6,669,577 B1 12/2003 Hocknell et al.
6,739,983 B2 5/2004 Helmstetter et al.
6,749,523 B1 6/2004 Forzano
6,769,996 B2 8/2004 Tseng
6,776,723 B2 8/2004 Bliss et al.
6,776,725 B1 8/2004 Miura et al.
6,783,465 B2 8/2004 Matsunaga
RE38,605 E 9/2004 Kubica et al.
6,835,145 B2 12/2004 Tsurumaki
6,852,038 B2 2/2005 Yabu
6,923,734 B2 8/2005 Meyer
6,974,393 B2 12/2005 Caldwell et al.
6,979,270 B1 12/2005 Allen
7,008,332 B2 3/2006 Liou
7,056,228 B2 6/2006 Beach et al.
7,066,835 B2 6/2006 Evans et al.
7,074,136 B2 7/2006 Noguchi
7,083,529 B2 8/2006 Cackett et al.
7,108,609 B2 9/2006 Stites et al.
7,108,614 B2 9/2006 Lo
7,128,661 B2 10/2006 Soracco et al.
7,137,905 B2 11/2006 Kohno
7,147,573 B2 12/2006 DiMarco
7,166,041 B2 1/2007 Evans
7,175,541 B2 2/2007 Lo
7,186,190 B1 * 3/2007 Beach ..... A63B 53/06 473/335
7,241,229 B2 7/2007 Poyno
7,247,103 B2 7/2007 Beach et al.
7,250,007 B2 7/2007 Lu
7,258,624 B2 8/2007 Kobayashi
7,273,423 B2 9/2007 Imamoto
D553,206 S 10/2007 Morales et al.
7,281,992 B2 10/2007 Tseng
7,300,359 B2 11/2007 Hocknell et al.
D557,362 S 12/2007 Serrano et al.
7,303,487 B2 12/2007 Kumanmoto
7,326,126 B2 2/2008 Holt et al.
7,335,113 B2 2/2008 Hocknell et al.
7,351,161 B2 4/2008 Beach
7,387,579 B2 6/2008 Lin et al.
7,419,441 B2 9/2008 Hoffman et al.
7,445,563 B1 11/2008 Werner
7,448,964 B2 11/2008 Schweigert et al.
7,494,424 B2 2/2009 Williams et al.
7,510,485 B2 3/2009 Yamamoto
7,520,820 B2 4/2009 DeMarco et al.
7,563,177 B2 7/2009 Jertson et al.
7,563,178 B2 7/2009 Rae et al.
7,591,736 B2 9/2009 Ban
7,597,634 B2 10/2009 Werner et al.
7,611,424 B2 11/2009 Nagai et al.
7,632,196 B2 12/2009 Reed et al.
7,641,568 B2 1/2010 Hoffman et al.
7,686,708 B2 3/2010 Morales et al.
7,691,006 B1 4/2010 Burke

(56) References Cited

U.S. PATENT DOCUMENTS 7,699,719 B2 4/2010 Sugimoto
7,744,484 B1 6/2010 Chao
7,749,103 B2 7/2010 Nakano
7,771,291 B1 8/2010 Willett
7,775,905 B2 8/2010 Beach et al.
7,798,203 B2 9/2010 Schweigert et al.
7,824,277 B2 11/2010 Bennett et al.
7,892,111 B2 2/2011 Morales et al.
7,914,393 B2 3/2011 Hirsch et al.
7,927,231 B2 4/2011 Sato et al.
7,959,523 B2 6/2011 Rae et al.
7,967,700 B2 6/2011 Stites
8,016,694 B2 9/2011 Llewellyn et al.
8,025,587 B2 9/2011 Beach et al.
8,147,354 B2 4/2012 Hartwell et al.
8,187,119 B2 5/2012 Rae et al.
8,192,303 B2 6/2012 Ban
8,197,357 B1 6/2012 Rice et al.
8,202,175 B2 6/2012 Ban
8,206,244 B2 6/2012 Honea et al.
8,216,087 B2 7/2012 Breier et al.
8,298,096 B2 10/2012 Stites et al.
8,337,319 B2 12/2012 Sargent et al.
8,357,056 B2 1/2013 Horacek et al.
8,357,058 B2 1/2013 Honea et al.
8,403,771 B1 3/2013 Rice et al.
8,491,415 B2 7/2013 Demille et al.
8,523,702 B2 9/2013 Thomas et al.
8,523,705 B2 9/2013 Breier et al.
8,540,587 B2 9/2013 Hirsch et al.
8,591,352 B2 11/2013 Hirano
8,591,353 B1 11/2013 Honea et al.
8,608,585 B2 12/2013 Stites et al.
8,608,591 B2 12/2013 Chao et al.
8,641,547 B2 2/2014 Rauchholz et al.
8,647,216 B2 2/2014 Seluga et al.
8,696,491 B1 * 4/2014 Myers ..... A63B 60/02 473/345
8,747,251 B2 6/2014 Hayase et al.
8,758,164 B2 * 6/2014 Breier ..... A63B 60/54 473/332
8,771,097 B2 7/2014 Bennett et al.
8,834,293 B2 9/2014 Thomas et al.
8,870,679 B2 10/2014 Oldknow
8,979,671 B1 3/2015 Demille et al.
9,067,110 B1 6/2015 Seluga et al.
9,079,078 B2 7/2015 Greensmith
9,084,921 B1 * 7/2015 Liang ..... A63B 53/0466
9,101,811 B1 8/2015 Goudarzi et al.
9,180,349 B1 11/2015 Seluga et al.
9,216,332 B1 12/2015 Ehlers et al.
9,259,625 B2 2/2016 Sargent et al.
9,289,660 B1 3/2016 Myers
9,399,157 B2 7/2016 Greensmith
9,486,677 B1 11/2016 Seluga et al.
9,597,558 B1 3/2017 Seluga et al.
9,623,291 B2 4/2017 Greensmith et al.
9,636,553 B1 * 5/2017 Myers ..... A63B 60/52
9,675,856 B1 * 6/2017 Gibbs ..... A63B 53/047
9,687,702 B1 6/2017 Seluga et al.
9,694,257 B1 7/2017 Seluga et al.
9,731,178 B1 * 8/2017 Myers ..... A63B 60/04
9,757,630 B2 * 9/2017 Mata ..... A63B 53/0466
9,776,058 B2 10/2017 Seluga et al.
9,795,840 B2 10/2017 Greensmith
9,814,947 B1 11/2017 Seluga et al.
9,814,954 B2 11/2017 Westrum et al.
9,868,036 B1 * 1/2018 Kleinert ..... A63B 53/06
9,914,027 B1 * 3/2018 Harbert ..... A63B 60/00
9,943,733 B2 4/2018 Franklin et al.
10,035,049 B1 * 7/2018 Nielson ..... A63B 60/52
10,046,212 B2 * 8/2018 Sargent ..... A63B 60/00
10,076,688 B1 * 9/2018 Harbert ..... A63B 60/00
10,086,240 B1 * 10/2018 Hoffman ..... A63B 53/0466
10,183,202 B1 * 1/2019 Harbert ..... A63B 60/52
10,293,225 B2 * 5/2019 Sargent ..... A63B 53/0466
10,300,356 B2 * 5/2019 Mata ..... A63B 53/06
10,463,927 B2 * 11/2019 Bovee ..... A63B 53/0466
10,537,773 B2 * 1/2020 Nielson ..... A63B 60/02
10,646,755 B1 * 5/2020 Kleinert ..... A63B 53/0466
10,695,628 B1 * 6/2020 Yi ..... A63B 53/08
10,751,585 B2 * 8/2020 Johnson ..... A63B 60/00
10,874,914 B2 * 12/2020 Johnson ..... A63B 53/02
10,888,742 B2 1/2021 Greensmith et al.
10,905,923 B2 * 2/2021 Bovee ..... A63B 53/02
11,007,408 B2 * 5/2021 Mata ..... A63B 53/0466
11,077,344 B2 * 8/2021 Nielson ..... A63B 60/00
11,179,610 B2 * 11/2021 Sargent ..... A63B 53/0466
11,541,286 B2 * 1/2023 Mata ..... A63B 60/00
2002/0137576 A1 9/2002 Dammen
2003/0104878 A1 6/2003 Yabu
2003/0134688 A1 7/2003 Rice
2003/0153401 A1 8/2003 Helmstetter et al.
2004/0116207 A1 6/2004 De Shiell et al.
2004/0192468 A1 9/2004 Onoda et al.
2005/0037861 A1 2/2005 Kobayashi et al.
2005/0143189 A1 6/2005 Lai et al.
2005/0221913 A1 10/2005 Kusumoto
2005/0261082 A1 11/2005 Yamamoto
2006/0019769 A1 1/2006 Lo
2006/0052181 A1 3/2006 Serrano et al.
2006/0122004 A1 6/2006 Chen et al.
2006/0172821 A1 * 8/2006 Evans ..... A63B 60/02 473/349
2006/0178228 A1 * 8/2006 DiMarco ..... A63B 60/02 473/345
2006/0217216 A1 9/2006 Iizuka
2006/0223651 A1 10/2006 Borunda
2006/0240908 A1 10/2006 Adams et al.
2006/0293118 A1 12/2006 Meyer et al.
2007/0032313 A1 2/2007 Serrano et al.
2007/0135231 A1 6/2007 Lo
2007/0155529 A1 7/2007 Voges
2007/0155533 A1 7/2007 Soheim et al.
2007/0178988 A1 8/2007 Tavares et al.
2007/0232408 A1 10/2007 Horacek
2007/0265108 A1 11/2007 Lin et al.
2008/0020861 A1 1/2008 Adams et al.
2008/0045356 A1 2/2008 Lin et al.
2008/0070721 A1 3/2008 Chen et al.
2008/0076590 A1 3/2008 Hsu
2008/0132355 A1 6/2008 Hoffman
2008/0146370 A1 * 6/2008 Beach ..... A63B 60/00 473/336
2008/0194354 A1 8/2008 Nagai et al.
2008/0254908 A1 10/2008 Bennett et al.
2008/0261715 A1 10/2008 Carter
2008/0280693 A1 11/2008 Chai
2009/0011849 A1 1/2009 Thomas et al.
2009/0031551 A1 2/2009 Schweigert et al.
2009/0124407 A1 5/2009 Hocknell et al.
2009/0143167 A1 6/2009 Evans
2009/0203462 A1 8/2009 Stites et al.
2009/0286611 A1 11/2009 Beach et al.
2009/0286619 A1 11/2009 Beach et al.
2009/0298613 A1 12/2009 Hirsch et al.
2010/0041491 A1 2/2010 Thomas et al.
2010/0069170 A1 3/2010 Bennett et al.
2010/0075773 A1 3/2010 Casati, Jr.
2010/0075774 A1 3/2010 Ban
2010/0093462 A1 4/2010 Stites et al.
2010/0144461 A1 6/2010 Ban
2010/0151964 A1 6/2010 Soracco et al.
2010/0167837 A1 7/2010 Ban
2010/0197424 A1 8/2010 Beach et al.
2010/0234122 A1 9/2010 Sander et al.
2010/0255931 A1 10/2010 Ni et al.
2010/0273565 A1 10/2010 Stites et al.
2010/0292018 A1 11/2010 Cackett et al.
2010/0292027 A1 11/2010 Beach et al.
2010/0304887 A1 12/2010 Bennett et al.
2010/0317454 A1 12/2010 Sato et al.
2010/0323808 A1 12/2010 Sato et al.
2010/0331101 A1 12/2010 Sato et al.

(56) References Cited

U.S. PATENT DOCUMENTS

| | | | | |
|---|---|---|---|---|
| 2011/0009206 | A1 | 1/2011 | Soracco | |
| 2011/0009209 | A1 | 1/2011 | Llewellyn et al. | |
| 2011/0009210 | A1 | 1/2011 | Stites et al. | |
| 2011/0039631 | A1 | 2/2011 | Oldknow et al. | |
| 2011/0039634 | A1 | 2/2011 | Tavares et al. | |
| 2011/0152000 | A1 | 6/2011 | Sargent et al. | |
| 2011/0172027 | A1 | 7/2011 | Hirsch et al. | |
| 2011/0224017 | A1 | 9/2011 | Thomas et al. | |
| 2011/0275446 | A1 | 11/2011 | Rahrig et al. | |
| 2011/0306441 | A1 | 12/2011 | Tsukada et al. | |
| 2011/0312437 | A1* | 12/2011 | Sargent | A63B 53/06 473/335 |
| 2012/0071258 | A1 | 3/2012 | Yamaguchi et al. | |
| 2012/0071261 | A1 | 3/2012 | Yamamoto | |
| 2012/0094780 | A1 | 4/2012 | Slaughter et al. | |
| 2012/0122601 | A1 | 5/2012 | Beach et al. | |
| 2012/0165115 | A1 | 6/2012 | Matsunaga | |
| 2012/0178550 | A1 | 7/2012 | Solheim et al. | |
| 2012/0196701 | A1 | 8/2012 | Stites et al. | |
| 2012/0202615 | A1 | 8/2012 | Beach et al. | |
| 2012/0220387 | A1 | 8/2012 | Beach et al. | |
| 2012/0302367 | A1 | 11/2012 | Myrhum et al. | |
| 2012/0322573 | A1 | 12/2012 | Boyd et al. | |
| 2013/0090185 | A1* | 4/2013 | Boyd | A63B 60/04 473/337 |
| 2013/0102410 | A1 | 4/2013 | Stites et al. | |
| 2013/0130829 | A1 | 5/2013 | Bennett et al. | |
| 2013/0130834 | A1 | 5/2013 | Stites et al. | |
| 2013/0165252 | A1 | 6/2013 | Rice et al. | |
| 2013/0184099 | A1 | 7/2013 | Stites et al. | |
| 2013/0244808 | A1 | 9/2013 | Bennett et al. | |
| 2013/0324290 | A1 | 12/2013 | Oldknow et al. | |
| 2014/0038746 | A1 | 2/2014 | Beach et al. | |
| 2014/0051529 | A1 | 2/2014 | Honea et al. | |
| 2014/0057739 | A1 | 2/2014 | Stites et al. | |
| 2014/0080629 | A1* | 3/2014 | Sargent | A63B 53/02 473/336 |
| 2014/0113742 | A1 | 4/2014 | Zimmerman et al. | |
| 2014/0155193 | A1 | 6/2014 | Takechi et al. | |
| 2014/0187346 | A1 | 7/2014 | Beno | |
| 2014/0329616 | A1 | 11/2014 | Stokke et al. | |
| 2015/0031468 | A1 | 1/2015 | Matsunaga et al. | |
| 2015/0038261 | A1 | 2/2015 | Stites et al. | |
| 2015/0094166 | A1 | 4/2015 | Taylor et al. | |
| 2015/0273293 | A1 | 10/2015 | Akiyama | |
| 2015/0290503 | A1 | 10/2015 | Su et al. | |
| 2015/0298196 | A1 | 10/2015 | Su et al. | |
| 2015/0306473 | A1* | 10/2015 | Breier | A63B 53/06 473/409 |
| 2015/0306474 | A1* | 10/2015 | Breier | A63B 53/0466 473/332 |
| 2015/0306475 | A1* | 10/2015 | Curtis | A63B 53/06 473/345 |
| 2016/0059093 | A1* | 3/2016 | Nielson | A63B 53/02 473/338 |
| 2016/0101331 | A1 | 4/2016 | Luttrell et al. | |
| 2016/0250527 | A1 | 9/2016 | Seluga et al. | |
| 2016/0375326 | A1* | 12/2016 | Nunez | A63B 53/0466 473/335 |
| 2017/0072277 | A1* | 3/2017 | Mata | A63B 60/52 |
| 2017/0354853 | A1* | 12/2017 | Mata | A63B 60/52 |
| 2018/0154224 | A1* | 6/2018 | Bovee | A63B 53/02 |
| 2018/0290030 | A1* | 10/2018 | Nielson | A63B 53/02 |
| 2018/0345093 | A1* | 12/2018 | Harbert | A63B 53/0466 |
| 2019/0022478 | A1* | 1/2019 | Greaney | A63B 53/0466 |
| 2019/0022480 | A1* | 1/2019 | Harbert | A63B 53/0466 |
| 2019/0134470 | A1 | 5/2019 | Greensmith et al. | |
| 2019/0192930 | A1 | 6/2019 | Cleghorn et al. | |
| 2019/0232129 | A1 | 8/2019 | Nunez et al. | |
| 2019/0269984 | A1* | 9/2019 | Mata | A63B 60/00 |
| 2020/0061427 | A1* | 2/2020 | Bovee | A63B 60/00 |
| 2020/0206591 | A1* | 7/2020 | Nielson | A63B 53/0466 |
| 2021/0308536 | A1* | 10/2021 | Mata | A63B 60/00 |
| 2022/0088446 | A1* | 3/2022 | Harbert | A63B 53/0466 |

FOREIGN PATENT DOCUMENTS

| | | | | |
|---|---|---|---|---|
| JP | 10201886 | | 8/1998 | |
| JP | 4001970 | | 10/1998 | |
| JP | H11155982 | | 6/1999 | |
| JP | 4009359 | | 10/1999 | |
| JP | 3211755 | | 9/2001 | |
| JP | 2001238988 | | 9/2001 | |
| JP | 2002052099 | | 2/2002 | |
| JP | 2002113134 | | 4/2002 | |
| JP | 2002126136 | | 5/2002 | |
| JP | 3854066 | | 7/2002 | |
| JP | 2003088601 | | 3/2003 | |
| JP | 4098583 | | 5/2003 | |
| JP | 2004159794 | | 6/2004 | |
| JP | 3109501 | U | 3/2005 | |
| JP | 2005111172 | | 4/2005 | |
| JP | 3109209 | U | 5/2005 | |
| JP | 2005137788 | | 6/2005 | |
| JP | 4411972 | | 7/2005 | |
| JP | 3113023 | U | 9/2005 | |
| JP | 2005287529 | | 10/2005 | |
| JP | 2005312942 | | 11/2005 | |
| JP | 2006116002 | | 5/2006 | |
| JP | 2006167163 | | 6/2006 | |
| JP | 2006192110 | | 7/2006 | |
| JP | 3124540 | U | 8/2006 | |
| JP | 3124726 | U | 8/2006 | |
| JP | 3821516 | | 9/2006 | |
| JP | 4358766 | | 9/2006 | |
| JP | 2006263071 | | 10/2006 | |
| JP | 2006-320493 | | 11/2006 | |
| JP | 3126818 | U | 11/2006 | |
| JP | 4455442 | | 2/2007 | |
| JP | 2007044279 | | 2/2007 | |
| JP | 4466867 | | 4/2007 | |
| JP | 2007244715 | | 9/2007 | |
| JP | 2007267777 | | 10/2007 | |
| JP | 2007275547 | | 10/2007 | |
| JP | 4057286 | | 3/2008 | |
| JP | 2008086351 | | 4/2008 | |
| JP | 2008148762 | | 7/2008 | |
| JP | 2008295586 | | 12/2008 | |
| JP | 2009153802 | | 7/2009 | |
| JP | 4319420 | | 8/2009 | |
| JP | 4322104 | | 8/2009 | |
| JP | 2009172116 | | 8/2009 | |
| JP | 2009233266 | | 10/2009 | |
| JP | 4373765 | | 11/2009 | |
| JP | 2010029358 | | 2/2010 | |
| JP | 2010-136772 | | 6/2010 | |
| JP | 4566936 | B2 | 10/2010 | |
| JP | 2011-10722 | | 1/2011 | |
| JP | 4639749 | | 2/2011 | |
| JP | 2012176230 | A * | 9/2012 | A63B 53/00 |
| WO | WO 0108757 | | 2/2001 | |
| WO | WO-0108757 | A2 * | 2/2001 | A63B 53/04 |
| WO | WO 03061773 | | 7/2003 | |
| WO | WO-03061773 | A1 * | 7/2003 | A63B 24/0006 |

* cited by examiner

GOLF CLUB HEADS

CROSS-REFERENCE TO RELATED APPLICATIONS

This application is a continuation of U.S. patent application Ser. No. 17/233,201, filed Apr. 16, 2021, now U.S. Pat. No. 11,541,286, which is a continuation of U.S. patent application Ser. No. 16/415,778, filed May 17, 2019, now U.S. Pat. No. 11,007,408, which is a continuation of U.S. patent application Ser. No. 15/689,759, filed Aug. 29, 2017, now U.S. Pat. No. 10,300,356, which is a continuation of U.S. patent application Ser. No. 14/855,190, filed Sep. 15, 2015, now U.S. Pat. No. 9,757,630, both of which are incorporated by reference herein. This application also relates to U.S. Pat. Nos. 6,878,073 and 8,888,607; U.S. Patent Application Publication Nos. 2013/0172103, 2014/0080629, 2015/0011328 and 2015/0024870; U.S. patent application Ser. No. 14/717,864 filed May 20, 2015; and U.S. patent application Ser. No. 14/789,838 filed Jul. 1, 2015; all of which are incorporated by reference herein in their entireties and are considered to be part of the disclosure of this application.

FIELD

This application relates to golf clubs, and more particularly to golf club heads for wood-type golf clubs having improved acoustic properties.

BACKGROUND

A golf club set includes various types of clubs for use in different conditions or circumstances in which a ball is hit during a golf game. A set of clubs typically includes a driver for hitting the ball the longest distance on a course. Fairway woods, rescue clubs, and hybrid clubs can be used for hitting the ball shorter distances than the driver. A set of irons are used for hitting the ball within a range of distances typically shorter than the driver or woods. The acoustical properties of golf club heads, e.g., the sound a golf club head generates upon impact with a golf ball, affect the overall feel of a golf club by providing instant auditory feedback to the user of the club. For example, the auditory feedback can affect the feel of the club by providing an indication as to how well the golf ball was struck by the club, thereby promoting user confidence in the club and himself. The sound generated by a golf club head can be based in part on the rate, or frequency, at which the golf club head vibrates upon impact with the golf ball. Generally, for wood-type golf clubs (as distinguished from iron-type golf clubs), particularly those made of steel or titanium alloys, a desired frequency is generally around 3,000 Hz and preferably greater than 3,200 Hz. A frequency less than 2,800 Hz or 3,000 Hz may result in negative auditory feedback and thus a golf club with an undesirable feel.

Accordingly, it would be desirable to increase the vibration frequencies of golf club heads having relatively large volumes, relatively thin walls, and other frequency reducing features in order to provide a golf club head that provides desirable feel through positive auditory feedback but without sacrificing the head's ball-striking performance.

SUMMARY

Described herein are embodiments of wood-type golf club heads having a hollow body defining an interior cavity and comprising a sole, a crown, a skirt, a hosel, and a striking face. The golf club heads can include a front portion, rear portion, heel portion and toe portion. Examples of such golf club heads include wood-type golf club heads, such as drivers, fairway woods, rescue clubs, hybrid clubs, and the like.

Disclosed wood-type club heads can include one or more moveable weights coupled to the sole and corresponding recessed/concave ports that receive a weight and/or recessed/concave tracks about which one or more weights can be moved to adjust the mass properties of the club head. Some embodiments include a weight track that extends across the front of the sole in a heel-toe direction and some embodiments include a weight track that extends across the sole in a front-rear direction. Some embodiments include other concave regions on the sole and/or the crown. Such concavities, recesses, and other irregular structures in a wood-type golf club head can lead to detrimental effects on the acoustic properties of the club, such as reduced vibration frequencies. To counteract such detrimental effects on the acoustic properties, disclosed club heads can include various combinations of stiffening structures, such as internal ribs, posts, tubes, thickened wall regions, and other stiffening structures positioned within the interior cavity of the head.

The foregoing and other objects, features, and advantages of the disclosed technology will become more apparent from the following detailed description, which proceeds with reference to the accompanying figures.

DETAILED DESCRIPTION

Figure 1:
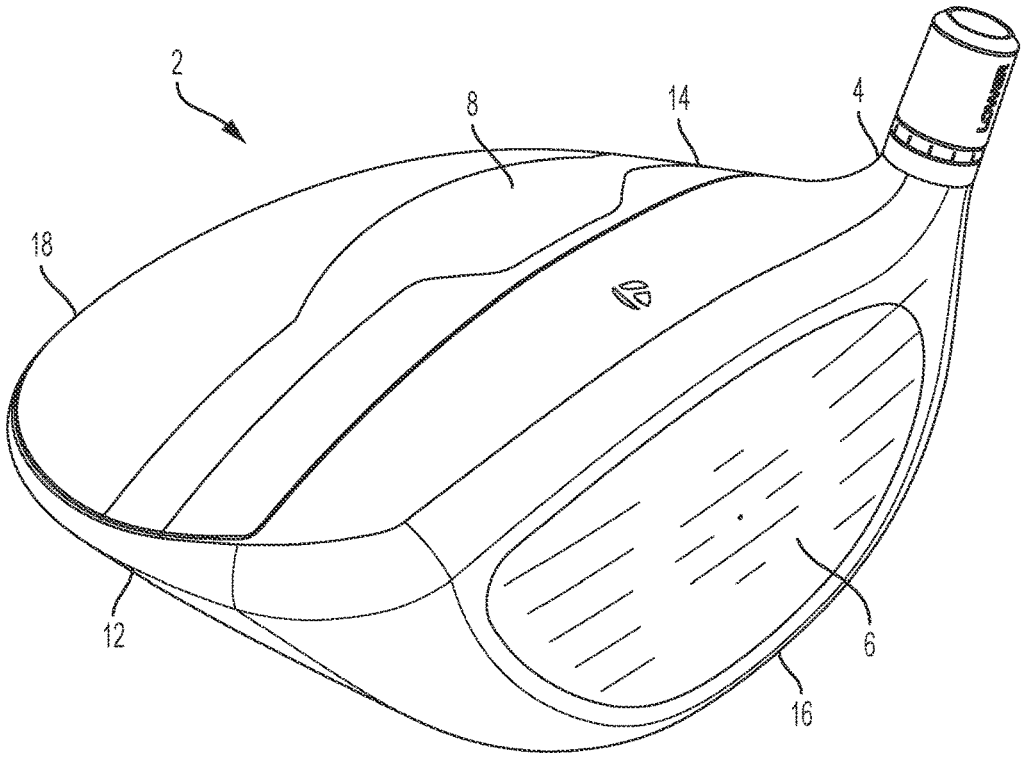
FIGS. 1-5 show various views of an exemplary wood-type golf club head having two recessed weight tracks in the sole.

The following disclosure describes embodiments of golf club heads for wood-type clubs (e.g., drivers, fairway woods, rescue clubs, hybrid clubs, etc.) that incorporate structures providing improved weight distribution, improved sound characteristics, improved adjustability features, and/or combinations of the foregoing characteristics. The disclosed embodiments should not be construed as limiting in any way. Instead, the present disclosure is directed toward all novel and nonobvious features and aspects of the various disclosed embodiments, alone and in various combinations and subcombinations with one another. Furthermore, any features or aspects of the disclosed embodiments can be used in any combination and subcombination with one another. The disclosed embodiments are not limited to any specific aspect or feature or combination thereof, nor do the disclosed embodiments require that any one or more specific advantages be present or problems be solved.

Throughout the following detailed description, a variety of examples of club heads for wood-type golf clubs are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Throughout the following detailed description, references will be made to channels, tracks, concavities, and recesses. Sometimes these words may be used interchangeably to describe a feature that may hold a slidably repositionable weight, such as, for example a forward channel or track in the sole. At other times, these words may refer to a feature in the club head designed to provide other characteristics and may not necessarily hold a weight. For example, some embodiments include concavities in the crown and sole that does not receive an adjustable weight. Still at other times a channel or track may be shown without an attached weight assembly, however this does not indicate that a weight assembly cannot be installed in the channel or track.

The present disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references may be used to facilitate discussion of the drawings but are not intended to be limiting. For example, certain terms may be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. Accordingly, the following detailed description shall not to be construed in a limiting sense.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C." As used herein, the term "coupled" generally means physically (e.g., mechanically, chemically, magnetically, etc.) coupled or linked and does not exclude the presence of intermediate elements between the coupled items absent specific contrary language.

To complement the disclosure described herein, additional information related to wood-type golf clubs can be found in one or more of the references that are incorporated by reference above. Much of this incorporated information is not repeated herein for purposes of brevity, but is still considered part of this disclosure.

Thin walled golf club heads, particularly wood-type golf club heads, can produce an undesirably low frequency sound (e.g., less than about 3,000 Hz) when striking a golf ball. This can be especially true for club heads that include weight tracks, weight ports, recesses, concavities, and/or other irregular features in the club head body. In order to stiffen the club head structure, and to thereby increase the frequency of the sound vibrations produced by the golf club head, one or more stiffening structures (e.g., ribs, posts, tubes, mass pads, thickened walls, etc.) may be included. Some such structures can be formed in or attached to (e.g., via welding) the interior cavity of the body of the club head.

Described below are several embodiments of golf club heads having one or more stiffening structures that increase the vibration frequency of the club head. In particular embodiments, a golf club head has an unsupported area, e.g., a weight track, weight port, depression, or concave portion, on an external portion of the club head. In specific implementations, the one or more stiffening structures connect with and/or extend at least partially along or within the unsupported area to improve properties, such as acoustical characteristics, of the golf club head upon impacting a golf ball.

FIGS. 1-10 show an exemplary wood-type golf club head 2 that includes a hosel 4, a ball-striking face, or strike face, 6, a crown 8, and a sole 10. The strike face 6 can be integrally formed with the body or attached to the body. The club head has toe side 12, a heel side 14, a front side 16, and a rear side 18.

Figure 8:
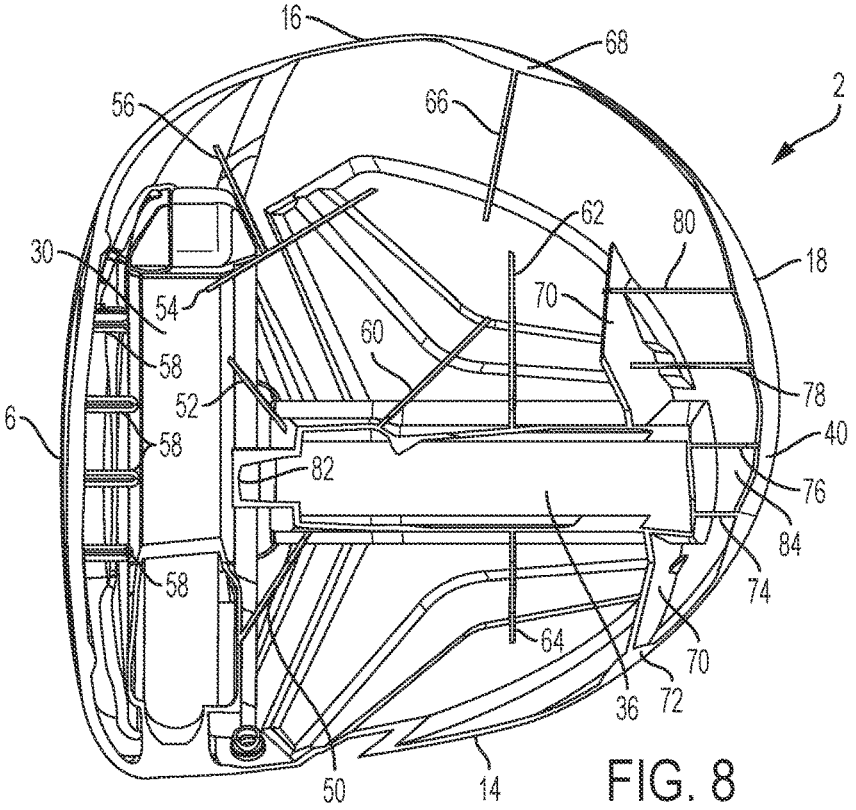
FIG. 8 is generally horizontal cross-sectional top-down view of a lower portion of the club head of FIG. 1, showing the interior side of the sole.
Figure 9:
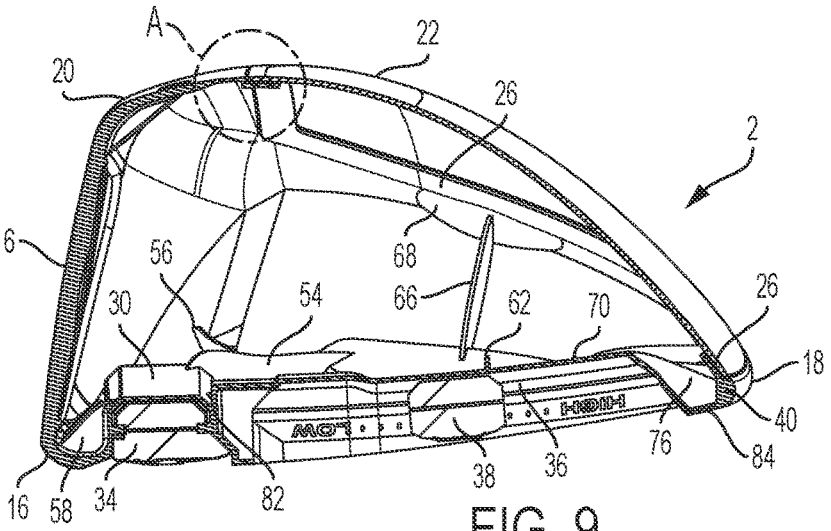
FIG. 9 is a generally vertical cross-sectional side view of a toe-side portion of the club head of FIG. 1.

The crown, sole, and skirt therebetween can have any of various shapes and contours. In the specific embodiment shown in FIGS. 1-10, the crown and skirt have generally rounded, convex profiles, while the sole is generally convex in shape, but includes a plurality of steps, recesses, and weight tracks that create localized concave portions in the exterior of sole (FIGS. 2-5), and corresponding convex surfaces in the interior of the sole (FIGS. 8 and 9).

Figure 2:
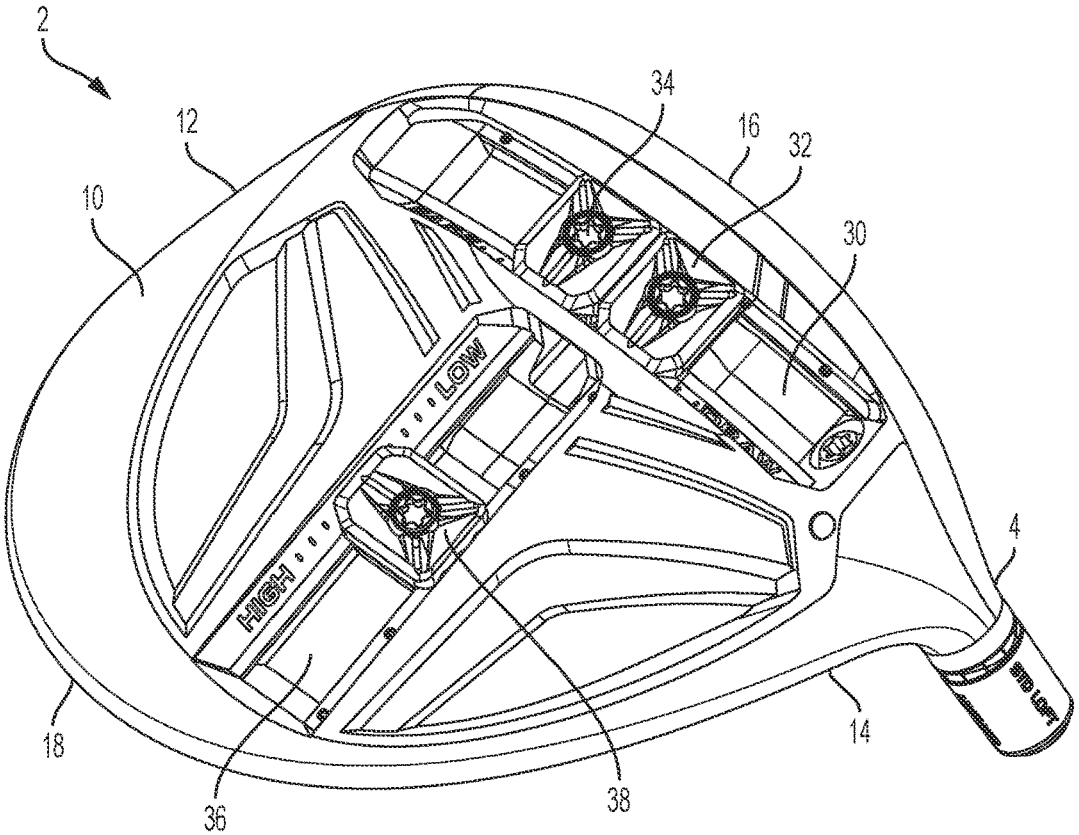
Figure 3:
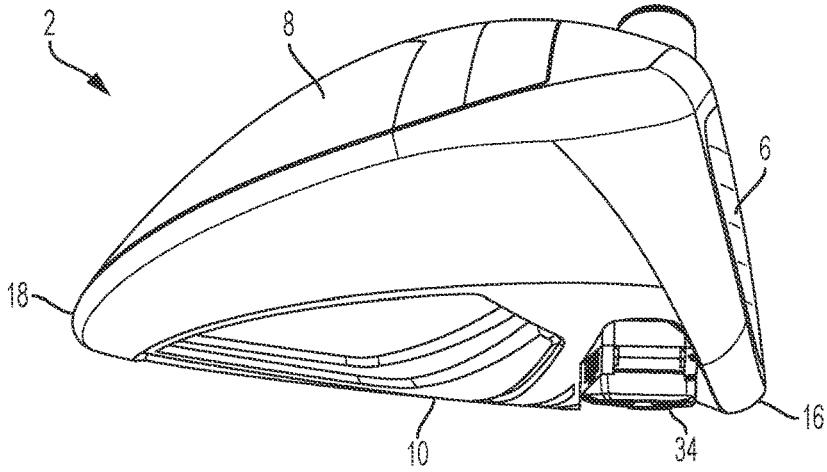
Figure 4:
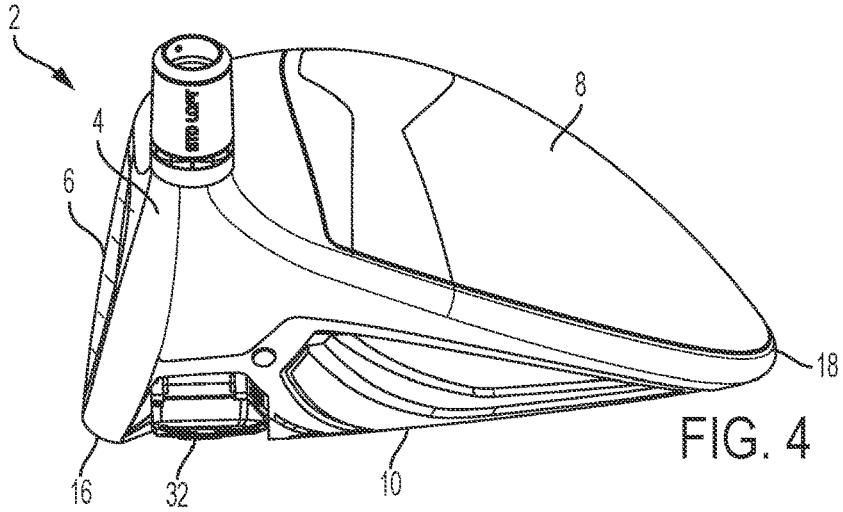
Figure 5:
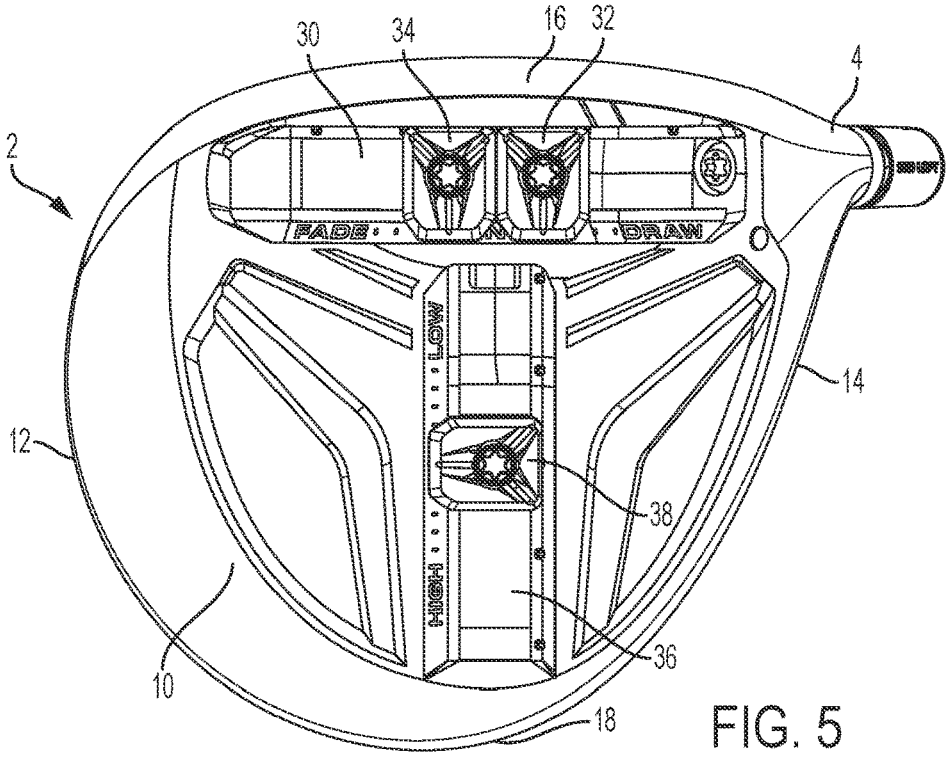

As shown in FIG. 2, the sole 10 includes a front weight track 30 that extends in a heel-toe direction adjacent the front 16 of the club head, and a rear weight track 36 that extends in a front-rear direction from adjacent the front weight track 30 to adjacent the rear 18 of the club head. One or more adjustable weight assemblies can be mounted in each weight track and can be adjusted along the length of the respective track to adjust the mass distribution properties of the club head. As shown, two weight assemblies 32, 34 are mounted in the front weight track 30 and one weight assembly 38 is mounted in the rear weight track 36. As shown in FIGS. 8 and 9, the weight tracks 30 and 36 create convex surfaces on the interior of the sole.

As discussed in U.S. patent application Ser. No. 14/789,838, the minimum distance between a vertical plane passing through the center of the face plate and the weight track 30 at the same x-coordinate as the center of the face plate is between about 10 mm and about 50 mm, such as between about 20 mm and about 40 mm, such as between about 25 mm and about 30 mm. In the embodiments shown, the width of the weight track (i.e., the horizontal distance between the front channel wall and rear channel wall adjacent to the locations of front ledge and rear ledge) may be between about 8 mm and about 20 mm, such as between about 10 mm and about 18 mm, such as between about 12 mm and about 16 mm. In the embodiments shown, the depth of the channel (i.e., the vertical distance between the bottom channel wall and an imaginary plane containing the regions of the sole adjacent the front and rear edges of the channel) may be between about 6 mm and about 20 mm, such as between about 8 mm and about 18 mm, such as between about 10 mm and about 16 mm. In the embodiments shown, the length of the weight track 30 (i.e., the horizontal distance between the heel end of the channel and the toe end of the channel) may be between about 30 mm and about 120 mm, such as between about 50 mm and about 100 mm, such as between about 60 mm and about 90 mm. The rear weight track 36 can have similar dimensions, but oriented in a front-rear direction rearward of the front weight track 30.

As also discussed in U.S. patent application Ser. No. 14/789,838, placing a mass member or weight assembly such as weight assemblies 32, 34, 38 into the weight tracks 30, 36 may require first angling the mass member relative to the channel and then inserting the mass member a sufficient distance underneath the rear ledge such that the mass member may rotate into position within the channel (see FIGS. 37A-37C of U.S. patent application Ser. No. 14/789,838). If the mass member is not inserted a sufficient distance it may not be able to rotate into position within the channel due to a possible interference with the front ledge of the channel. Once the mass member is rotated into position, then a washer may be attached to the mass member using a fastening bolt. The mass member may transition slightly towards the front ledge when slid along the channel.

Similarly, an entire weight assembly may be installed using the same method as just described. First, the fastening bolt is adjusted to be holding the assembly loosely together, then the entire assembly is positioned at an angle relative to the channel for insertion, then inserted into the channel such that the mass member and the washer sandwich a portion of the rear ledge, then the assembly may be rotated into position, adjusted so that the weight assembly is sandwiching both the front and rear ledges between the mass member and the washer, then the weight assembly may be slid to the desire position along the channel, and finally the fastening bolt may be tightened so as to securely engage the channel.

In some embodiments, the weight track or installation cavity can include a recessed or indented surface to facilitate installation of the mass member within the channel. For example, the recessed surface may be located between the rear ledge and the bottom channel wall. Additionally or alternatively, the installation cavity and recessed surface may be located at a toe end of the channel. Additionally or alternatively, the recessed surface may extend an entire length of the channel allowing for installation along the entire length of the channel. Additionally or alternatively, the recessed surface may be located between the front ledge and the bottom channel wall.

The recess, whether it extends the entire length of the channel or just a portion of the channel, should be sized appropriately to accept the mass member or weight assembly. Typically, this can be accomplished by making the channel dimensions slightly larger than the mass member so that mass member can slide with little resistance within the channel.

Figure 6:
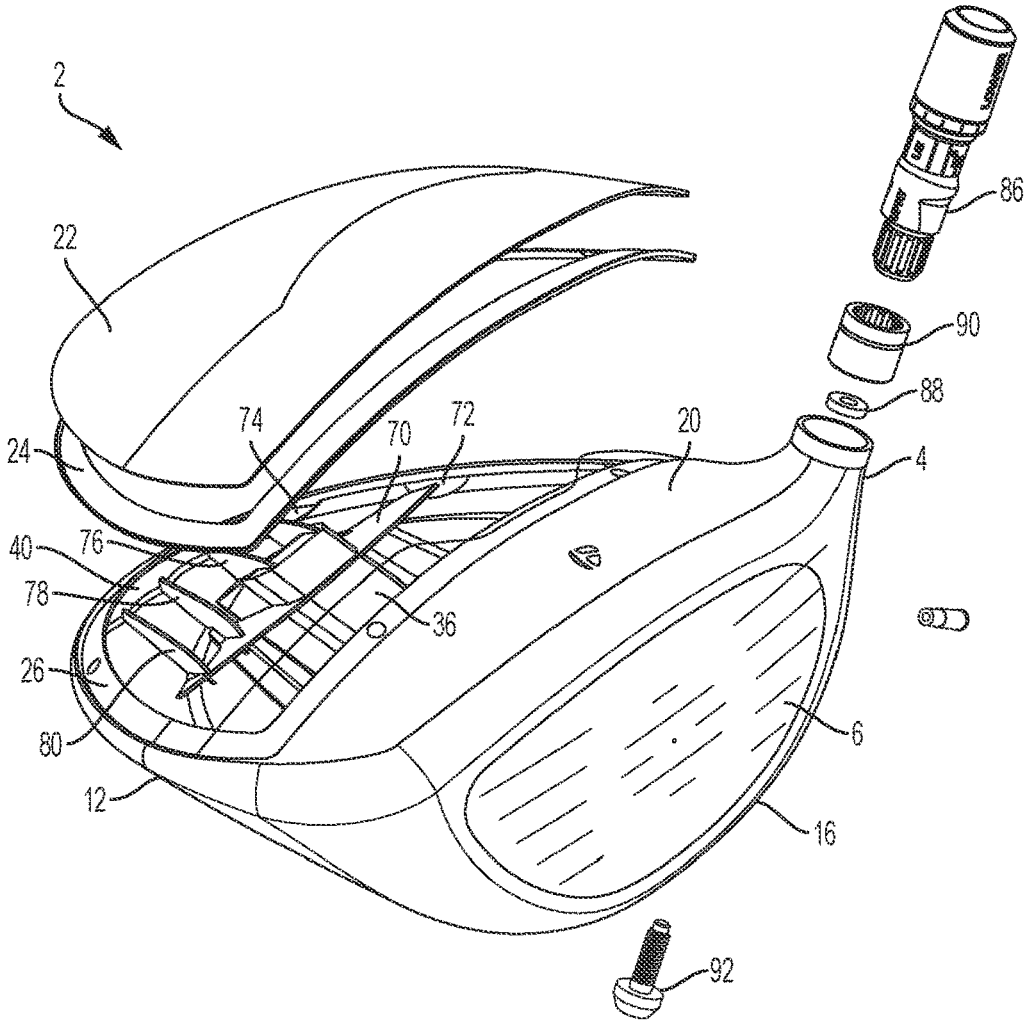
FIG. 6 is an exploded perspective view of the club head of FIG. 1.
Figure 7:
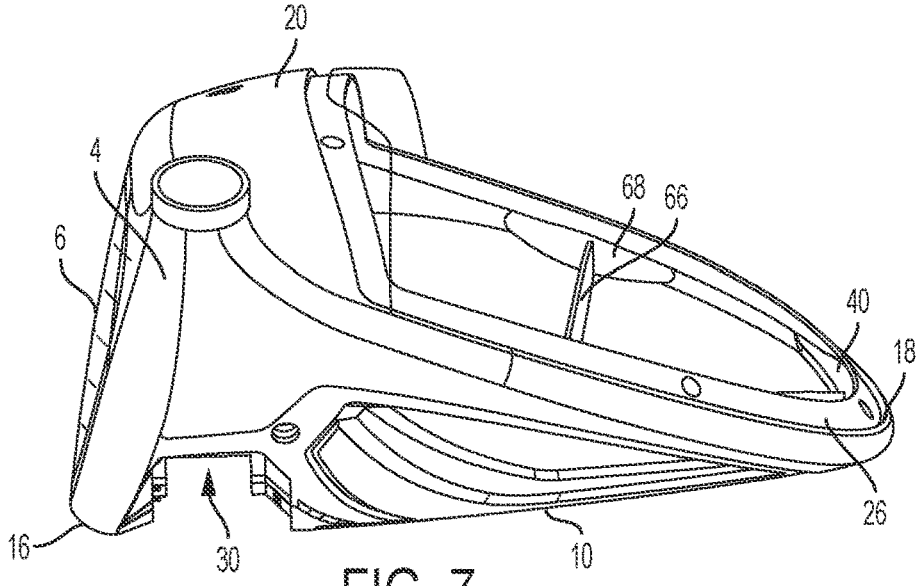
FIG. 7 is a heel-side view of the club head of FIG. 1 with the crown removed.
Figure 10:
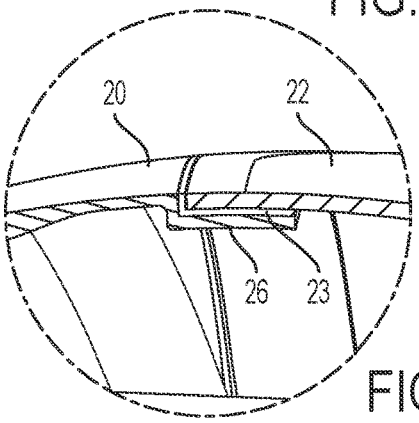
FIG. 10 is an enlarged view of a portion of FIG. 9.

As shown in FIGS. 6, 7, and 10, the crown can comprise a plate 22 that is coupled to recessed ledge 26. As shown the plate 22 may have some curvature. For example, the plate 22 may curve from the toe side 12 to the heel side 14, and the plate 22 may curve from the front side 16 to the rear side 18. The plate 22 may be attached to recessed ledge 26 by adhesive bonding or welding. The plate 22 can comprise a different material than the rest of the body. For example, the plate 22 can comprise a lower density material, such as a composite material (e.g., a fiber reinforced polymer composite).

In some embodiments, the mating surfaces of the plate 22 and recessed ledge 26 may be prepared by sandblasting to enhance bonding. In some embodiments, the plate 22 may be coupled to the recessed ledge 26 via a gasket-like joining member 24. The gasket-like joining member 24 may provide additional benefits, such as sound dampening and aiding with fit and finish such that the plate 22 joins smoothly with the club head body.

Some embodiments can comprise a cast titanium or titanium alloy crown that is integral with the body and/or not formed independently and then later attached to the body.

In any disclosed embodiments, the club head body is thin-walled. For example, the crown and skirt each may have an average thickness of from about 0.5 mm to about 1.2 mm, such as from about 0.65 mm to about 0.9 mm, or about 0.7 mm to about 0.8 mm. The sole may have an average thickness of from about 0.5 mm to about 2.0 mm, such as from about 1.0 mm to about 1.6 mm, or about 1.0 mm to about 1.4 mm.

The embodiment disclosed herein can also include an adjustable shaft attachment system for coupling a shaft to the hosel, the system including various components, such as a sleeve 86, a washer 88, a hosel insert 90, and a screw 92 as shown in FIG. 6 (more detail regarding the hosel and the adjustable shaft connection system can be found, for example, in U.S. Pat. No. 7,887,431 and U.S. patent application Ser. Nos. 14/789,838, 13/077,825, 12/986,030, 12,687,003, 12/474,973, which are incorporated herein by reference in their entirety). The shaft connection system, in conjunction with the hosel, can be used to adjust the orientation of the club head with respect to the shaft, as described herein and in the patents and applications incorporated by reference.

The golf club head 2 includes one or more stiffening structures. As used herein, a stiffening structure is defined generally as a structure having any of various shapes and sizes projecting or extending inwardly from any portion of the interior of the golf club head to provide structural support to, improved performance of, and/or acoustical enhancement of, the golf club head, and include at least ribs, posts, tubes, thickened wall portions, and mass pads. Stiffening structures can be co-formed with, coupled to, secured to, or attached to, the golf club head.

As shown in FIGS. 6-9, the club head 2 can comprise a plurality of internal ribs and/or mass pads that stiffen the club head. The club head 2 can comprise any one or more of the illustrated ribs, and/or additional ribs not shown. With reference to FIG. 8, the club head 2 can include a rib 50 that couples a heel portion of the front weight track 30 and/or the hosel 4 with a front portion of the rear weight track 36, a rib 52 that couples a toe portion of the track 30 with the front portion of the rear track 36, a rib 54 that couples a toe portion of the track 30 with a toe portion of the sole 10, a rib 56 that extends from the rib 54 toward and forward, a plurality of ribs 58 that extend from a front side of the track 30 to the front 16 of the club head, a rib 60 that extends from a toe side of the rear track 36 in a rearward and toeward direction across the sole, a rib 62 that extends toeward from the toe side of the rear track, a rib 64 that extends heelward from the heel side of the rear track (e.g., ribs 62 and 64 can be aligned and/or perpendicular to the front-rear axis of the rear track, and/or can form a single rib that extends across the rear track), a rib 66 that extends inwardly across the sole from a mass pad 68 on the toe side of the club head body, a rib 70 that extends in a heel-toe direction across the rear track 36 near the rear end of the rear track and couples to a mass pad 72 on the heel side of the club head body, ribs 74 and 76 that extend rearwardly from the rear end of the rear track 36 to a mass pad 40 formed in the rear of the club head body, and/or ribs 78 and 80 that extend rearwardly from the rib 70 to the mass pad 40 on the toe side of the rear track 36.

The ribs can have a generally vertical orientation, through some ribs, such as the rib 70, can be tilted from vertical. The ribs 70, 74, 76, 78, and 80 as well as mass pads 40 and 68 are further illustrated in FIG. 6, the rib 66 and mass pad 68 are illustrated in FIG. 7, and the ribs 54, 56, 58, 62, 66, 70, and 76 as well as mass pads 40 and 68 are further illustrated in FIG. 9.

The ribs help couple the various weight tracks and other irregular features on the sole and skirt regions together to provide a greater overall stiffness and higher vibration frequency. Additionally, the heel end of the front weight track 30 can be structurally integrated with, or coupled via stiffening structures to, the lower end of the hosel 4. Similarly, the front end of the rear mass track 36 can be integrated with, or coupled via stiffening structures to, the rear side of the front weight track 30, as shown at 82. The ribs 74 and 76 can extend across a rear portion 84 of the sole from the weight track 36 to the mass pad 40 at the rear end of the sole to further support the weight track.

The mass pads 40, 68 and/or 72 can comprise thickened wall portions and/or can comprise added material that is attached (e.g., welded) to the inner surfaces of the body walls to provide increased rigidity and structural support. The mass pads can have varying thickness that increases from a regular wall thickness at the perimeter of the mass pad to a maximum thickness near where the ribs join the mass pad. The regular wall thickness of the body at the perimeter of the mass pad can be 1.0 mm or less. In some embodiments, any of the mass pads can have a maximum thickness of at least 0.8 mm to 5.5 mm where a rib joins the mass pad. In some embodiments, the mass pad 40 can provide at least 0.2 grams to 4.0 grams of added mass (for titanium) or at least 0.3 grams to 7.0 grams of added mass, and/or at least 40-900 $mm^3$ of added material compared to a hypothetical embodiment where the mass pad is replaced with a regular wall section having a regular body wall thickness.

Each rib in a club head can have an associated mass and an associated benefit in terms of frequency (Hz) improvement. Accordingly, fewer ribs may be used to reduce the overall club weight, however the first mode frequency may be impacted, and in most cases will decrease. A sample rib pattern is shown in FIG. 8, which is similar to that shown in FIGS. 55C and 55D of U.S. application Ser. No. 14/789,838. Table 1 below shows the impact of selectively removing a single rib at a time from FIG. 55D of U.S. application Ser. No. 14/789,838. For example, removing rib 13 causes a 404 Hz detriment to the first mode frequency from 3411 Hz to 3006 Hz, whereas removing rib 5 improved the first mode frequency by 34 Hz. There is an array of satisfactory designs, one that was chosen was to remove ribs 5, 11, and 17 to achieve a first mode frequency of 3421 Hz. Similar effects on the first mode frequency of the club 2 would occur by removing/adding one or more of the ribs shown in FIG. 8. Such effects on the first mode frequency also apply to the ribs of the club head 100 shown in FIGS. 17 and 18.

| Rib | 1st Mode | Mass | Hz Penalty | Mass of Rib | Hz/g |
|---|---|---|---|---|---|
| 0 | 3411 | 206.6 | | | — |
| 1 | 3410 | 206.3 | 1 | 0.3 | 3.3 |
| 2 | 3336 | 206 | 74 | 0.3 | 246.7 |
| 3 | 3375 | 205.9 | 36 | 0.4 | 90.0 |
| 4 | 3434 | 206.5 | −23 | 0.1 | −230.0 |
| 5 | 3444 | 206.4 | −34 | 0.2 | −170.0 |
| 6 | 3336 | 206 | 74 | 0.3 | 246.7 |
| 7 | 3370 | 206.1 | 40 | 0.2 | 200.0 |
| 8 | 3378 | 205.8 | 32 | 0.5 | 64.0 |
| 9 | 3305 | 205.7 | 105 | 0.6 | 175.0 |
| 10 | 3352 | 205.2 | 58 | 1.1 | 52.7 |
| 11 | 3388 | 205.7 | 22 | 0.6 | 36.7 |
| 12 | 3374 | 205.6 | 36 | 0.7 | 51.4 |
| 13 | 3006 | 205.2 | 404 | 1.1 | 367.3 |
| 14 | 3381 | 205.8 | 29 | 0.5 | 58.0 |
| 15 | 3248 | 205.7 | 162 | 0.6 | 270.0 |
| 16 | 3377 | 206.1 | 33 | 0.2 | 165.0 |
| 17 | 3404 | 206 | 6 | 0.3 | 20.0 |
| Total | | | 1055 | 8 | 131.9 |

FIGS. 11-18 show an exemplary wood-type golf club head 100 that includes a hosel 104, a ball-striking face, or strike face, 106, a crown 108, and a sole 110. The strike face 106 can be integrally formed with the body or attached to the body. The club head has toe side 112, a heel side 114, a front side 116, and a rear side 118.

Figure 11:
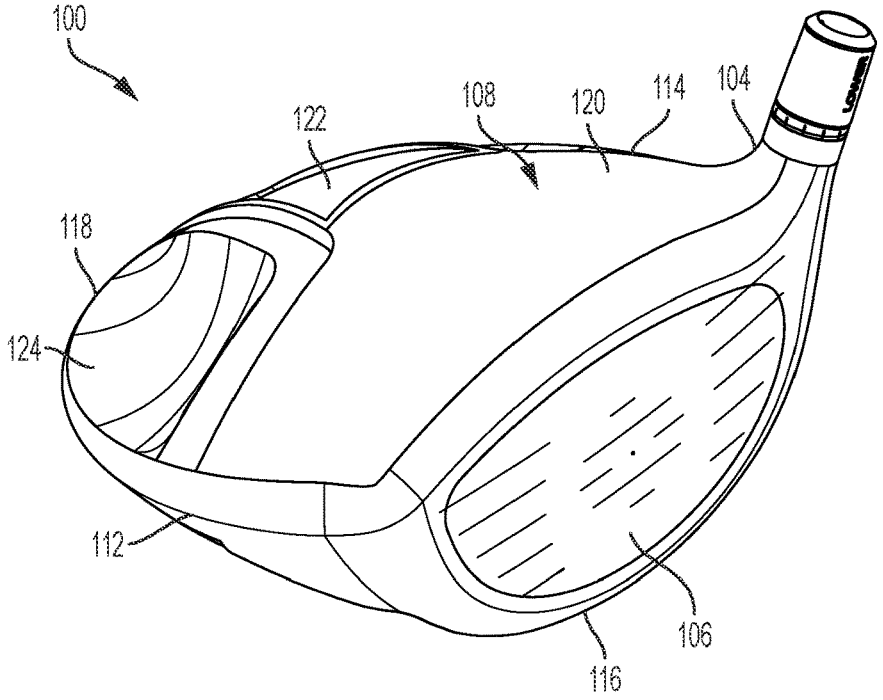
FIGS. 11-16 show various views of an exemplary wood-type golf club head having a recessed weight track in the front of the sole, a weight port in the rear of the sole, and concave regions in the rear of the crown.
Figure 12:
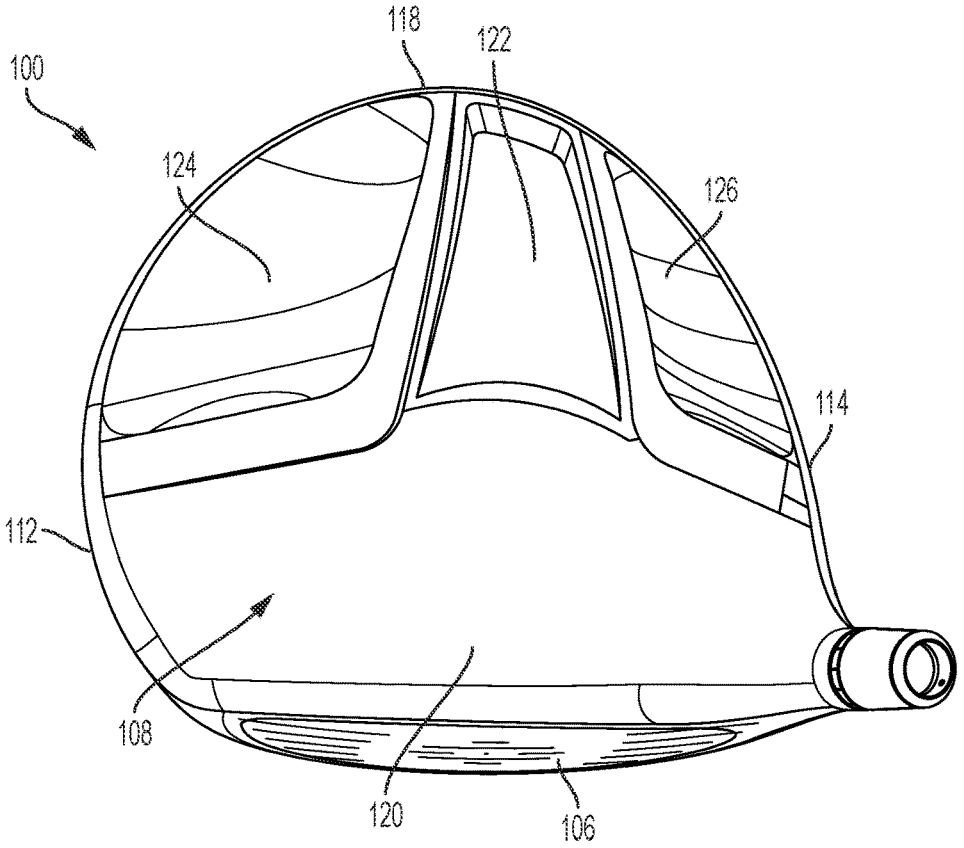

The crown, sole, and skirt therebetween can have any of various shapes and contours. In the specific embodiment shown in FIGS. 11-18, the crown, sole, and skirt have generally convex outer surfaces, but include a plurality of concavities, recesses, and weight tracks that create localized concave portions in the exterior of crown and sole, and corresponding convex surfaces in the interior of the crown and sole. As shown in FIGS. 11-12, the crown 108 includes a convex front portion 120 and concave regions 122, 124, 126 in the rear of the crown.

Figure 13:
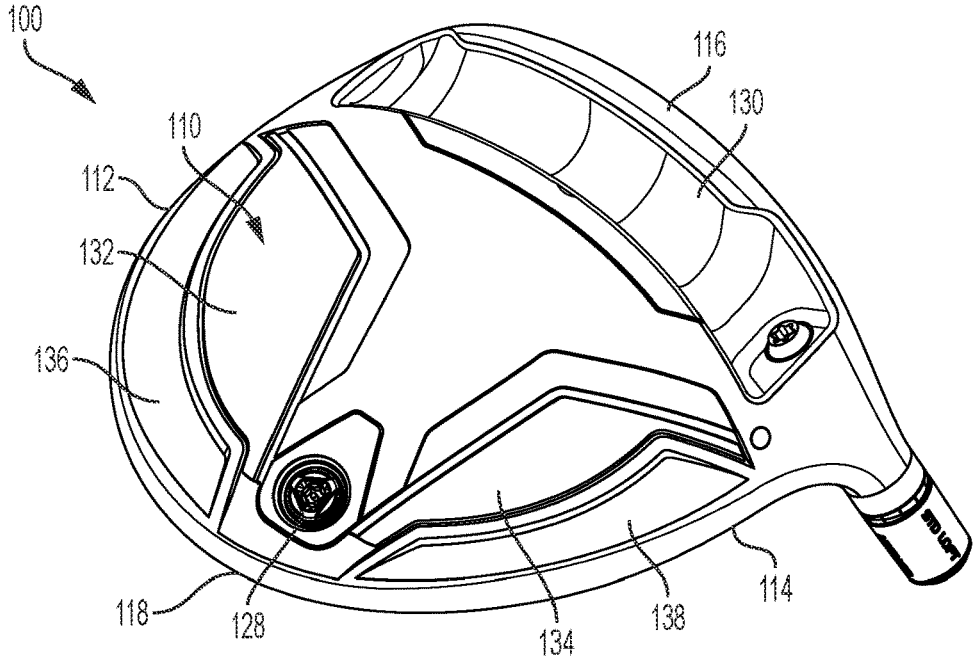
Figure 14:
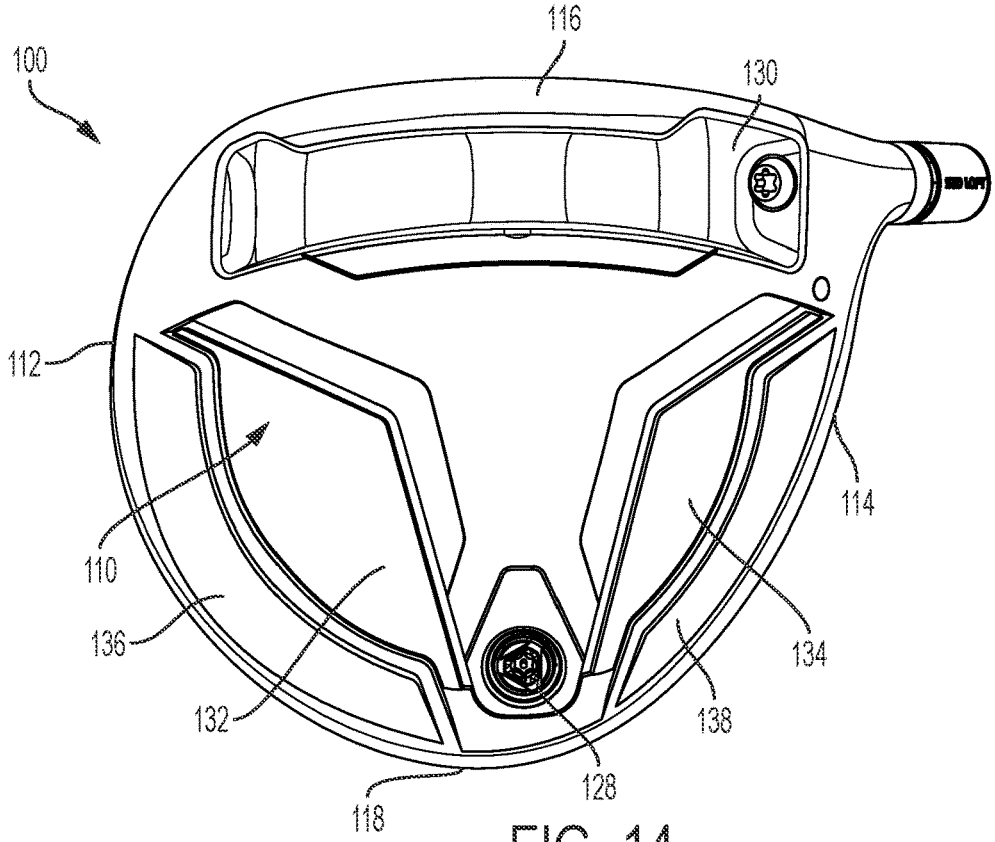
Figure 15:
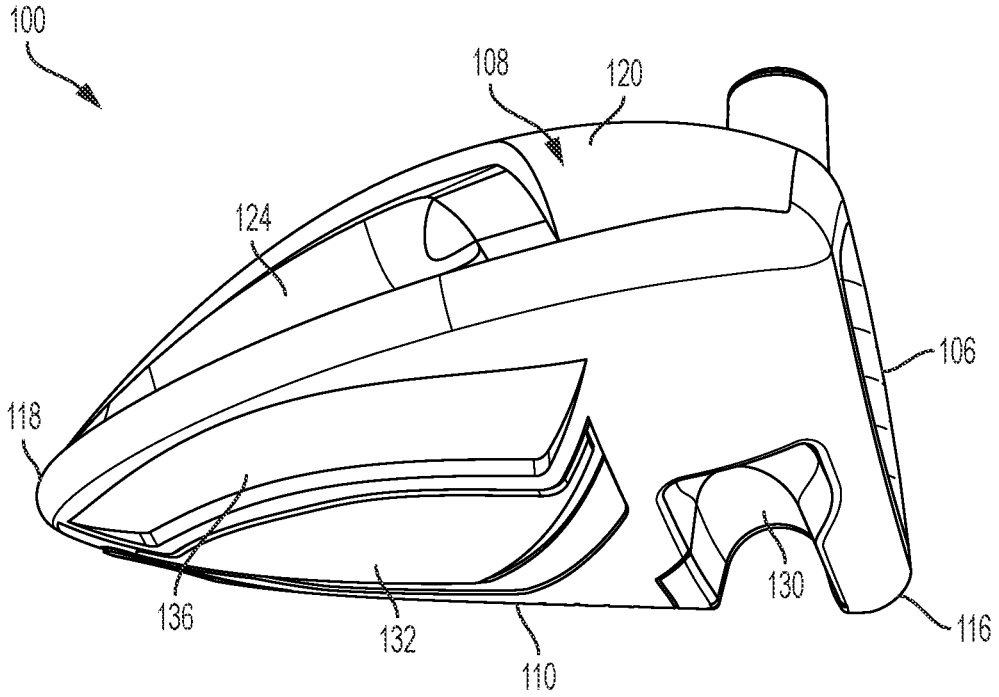
Figure 16:
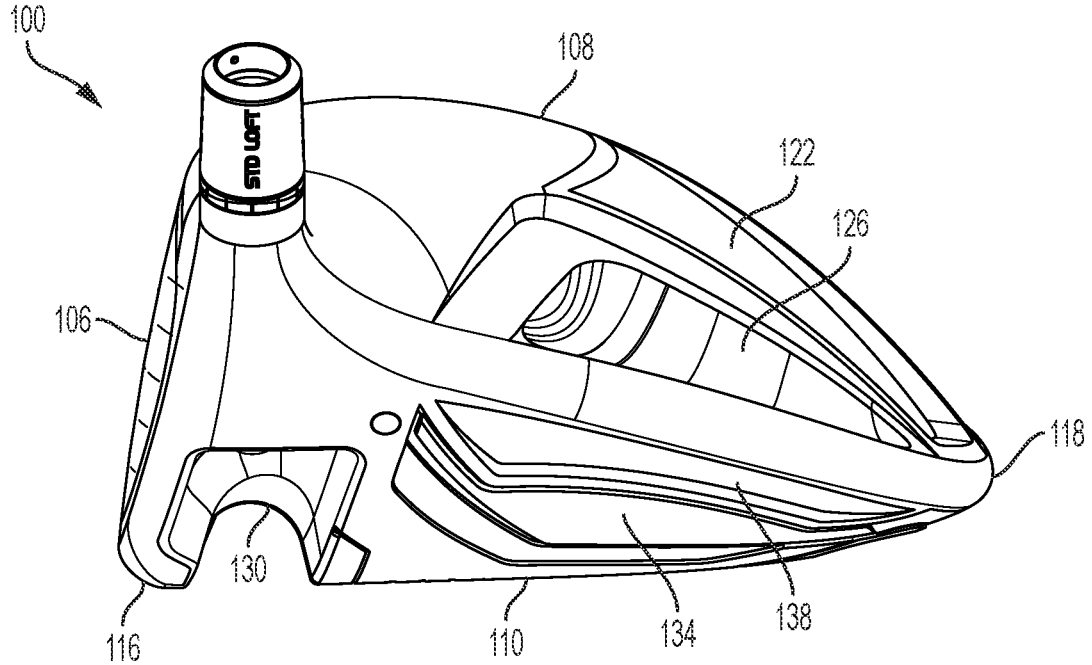

As shown in FIG. 13, the sole 110 includes a front channel 130 that extends in a heel-toe direction adjacent the front 116 of the club head, and concave regions 132, 134, 136, 138 in the rear of the sole. A weight port 128 is also included in the rear of the sole. In some embodiments, one or more adjustable weight assemblies can be mounted in the channel 130 and/or one or more adjustable weight assemblies can be mounted in the weight port 128. In such embodiments, the weight assemblies can be adjusted in position relative to the club head body to adjust the mass distribution properties of the club head.

In some embodiments, a stationary weight can be positioned in or adjacent to the front channel 130. For example, a weight can be mounted in the channel 130 without the ability to slide along the channel. In some embodiments, a weight or extra mass can be positioned in or behind the rear wall of the front channel 130. For example, a weight can be mounted in a recess in the sole located just behind the front channel and/or extending rearwardly from the front channel. Such a weight can be secured to the sole with a screw or other fastener and can be removable and replaceable with weight having different masses. In embodiments having a weight mounted in the front channel, the front channel can be specifically shaped for receiving and retaining the weight and/or to allow the weight to slide along the channel and be secured in different side-to-side positions along the channel. In some embodiments, a weight can be secured in the front channel with a gap formed between the front of the weight and the front wall of the channel. For example, FIG. 18 of U.S. Pat. No. 8,888,607 (which is incorporated herein by reference in its entirety) shows a weight 250 mounted in a front channel 260 in the sole 14 with a gap 258 formed between the front portion of the weight 250 and the front wall of the channel 260. Such a gap can provide various benefits, such as allowing the lower part of the face and/or front part of the sole to deflect rearwardly to a greater extent when striking a golf ball, which can lead to a high COR.

Figure 17:
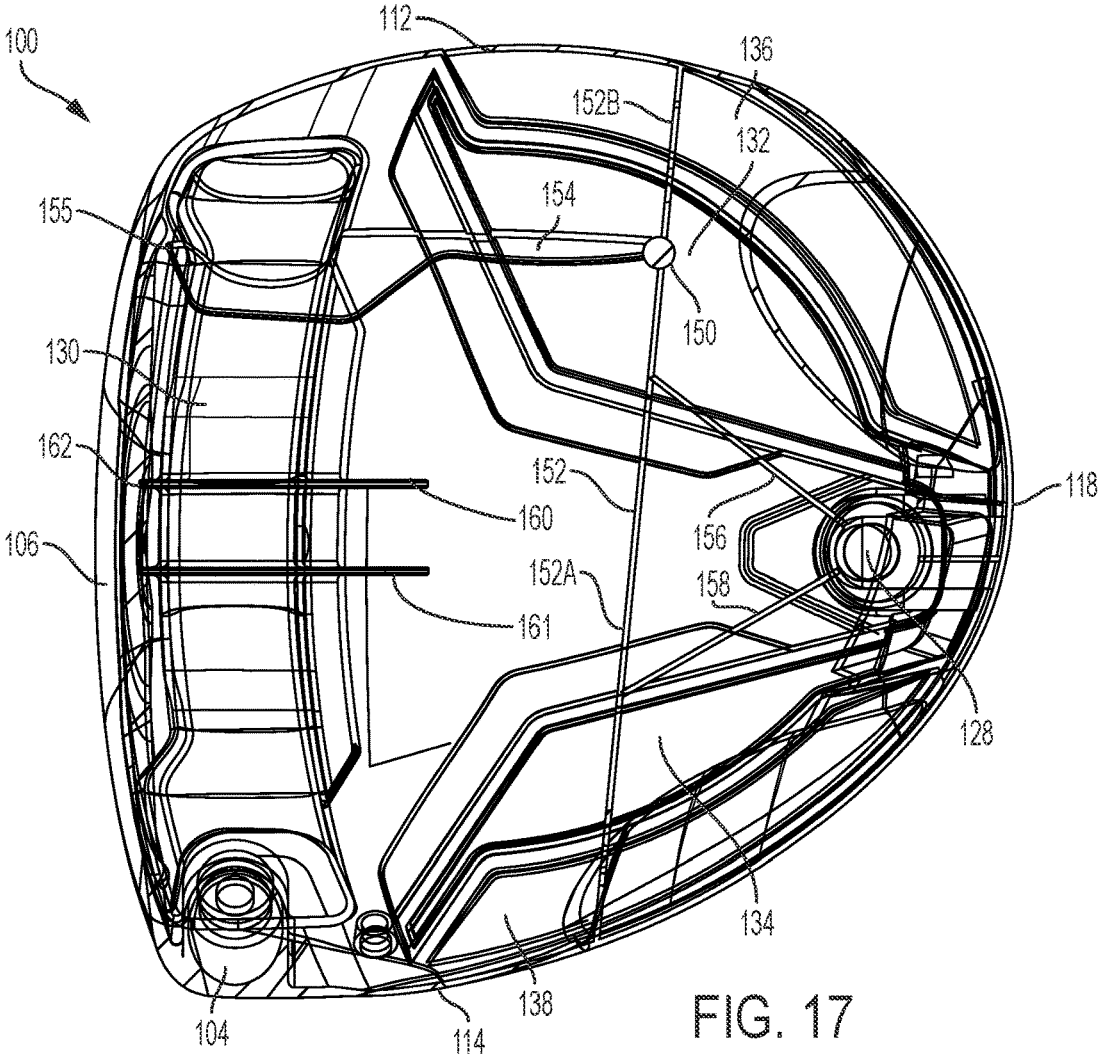
FIG. 17 is cross-sectional top view of a lower portion of the club head of FIG. 11, showing the interior side of the sole.
Figure 18:
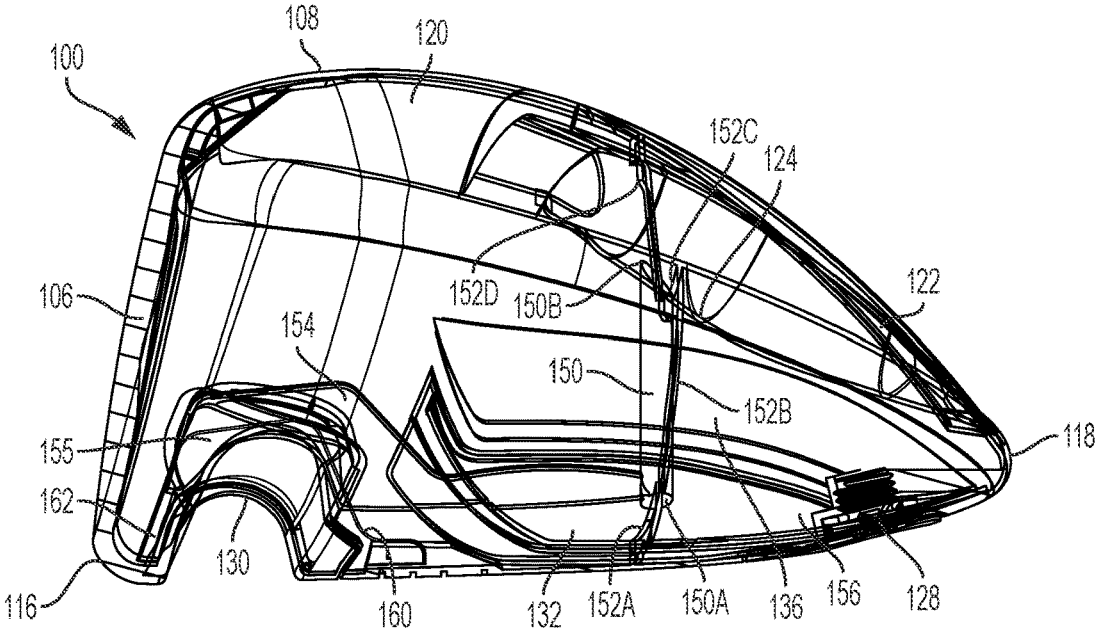
FIG. 18 is a cross-sectional side view of a toe portion of the club head of FIG. 11, illustrating various ribs and a vertical member extending between the sole and the crown through the interior cavity.

As shown in FIGS. 17 and 18, the crown concavities 122, 124, 126, the sole concavities 132, 134, 136, 138, and the channel 130 create convex surfaces on the interiors of the sole and crown.

The golf club head 100 includes one or more stiffening structures. The club head 100 can comprise a plurality of internal ribs and/or mass pads, as well as a post that couples the sole to the crown across the interior cavity. In some embodiments, the club head can comprise a post positioned within the interior cavity of the body at a location spaced between the front channel 130 and the rear end of the body and spaced between the toe and heel sides of the body. The post can comprise an elongated member having a lower end coupled to the sole, an upper end coupled to the crown, and an intermediate portion between the lower end and the upper end that is suspended within the interior cavity apart from the body. An exemplary post 150 is shown in FIGS. 17 and 18. A bottom end 150A of post 150 can be coupled to the sole, such as at the concavity 132, which projects upwardly into the interior cavity of the club head. An upper end 150B of the post 150 can be coupled to the crown, such as at the concavity 124, which projects downwardly into the interior cavity of the club head. The post 150 can comprise a solid rod, a partially or wholly hollow tube, an I-beam, X-beam, T-beam, or various other cross-sectional profiles. An intermediate portion of the post 150 between the ends 150A, 150B is suspended apart from the body walls within the cavity. The post 150 can be under tension (i.e., urging the crown and sole toward each other), under compression (i.e., urging the crown and sole apart from each other), or neither.

The club head 100 can also comprise any one or more of the illustrated ribs, and/or additional ribs not shown. With reference to FIG. 17, the club head 100 can include a rib or group of ribs that form an annular rib structure 152 that extends across the sole, the toe side of the body, the crown, and the heel side of the body, forming a ring around the inner surfaces of the sole, crown, and skirt. The rib structure 152 can form a complete or partial ring. The rib structure 152 can be substantially within a plane that extends in the sole-crown directions and the heel-toe directions, and is between the front and rear of the club head. The rib structure 152 can intersect with the top and/or bottom ends of the post 150, as shown in FIG. 18. The rib structure 152 can include a portion 152A that extends across the sole heelward of the bottom end of the post 150A, a portion 152B that extends across the sole toeward of the bottom end of the post 150A, a portion 152C that extends across the crown toeward of the top end of the post 150B, and a portion 152D that extends across the crown heelward of the top end of the post 150B. The rib 152C can extend across a portion of the concavity 124 and the rib 152D can extend across the concavities 122, 126, and a portion of the concavity 124. The rib structure 152 may or may not be continuous all the way around the internal surfaces of the body, and can include breaks or discontinuities.

The club head 100 can also comprise a rib 154 that extends from the bottom end of the post 150A forward across the sole, over a toe end portion of the front channel 130, and down to a point 155 adjacent the strike face 106. The club head 100 can also comprise a rib 156 that extends from the rib 152A rearward and toeward across the sole to the rear weight port 128, and a rib 158 that extends from the rib 152A rearward and heelward across the sole to the rear weight port 128. The club head 100 can also comprise ribs 160 and 161 that extend forwardly across the sole, over a mid-portion of the channel 130, and down to points 162 adjacent the front end of the sole. The ribs can have a generally vertical orientation, through some ribs can be tilted from vertical.

The ribs help couple the front channel 130, the rear weight port 128, and the various concavities in the crown and sole together to provide a greater overall stiffness and higher vibration frequency. Additionally, the heel end of the front channel 130 can be structurally integrated with, or coupled via stiffening structures to, the lower end of the hosel 4.

In more specific implementations, post 150 can comprise a tubular, thin-walled structure which may be hollow or may be partially solid. The post 150 may be formed of a metallic alloy (e.g., titanium alloy, aluminum alloy, steel alloy), a polymer-fiber composite material, or other material providing an appropriate combination of stiffness and light-weight. The post 150 can have an outer diameter of from about 2 mm to about 7 mm, such as from about 3 mm to about 6 mm, or about 4 mm to about 5 mm. The post 150, when tubular, can have a wall thickness of from about 0.25 mm to about 2.5 mm, such as from about 0.3 mm to about 1.5 mm, or from about 0.4 mm to about 1.0 mm, or about 0.5 mm.

The post 150 can be lightweight and compact. By way of example, in specific implementations, the mass of the post 150 can be approximately 8 grams or less, such as 6 grams or less. Of course, in other implementations, the particular dimensions of the post 150 and the ribs may vary, and optimal dimensions and combined mass may be different for different head designs.

Figure 19:
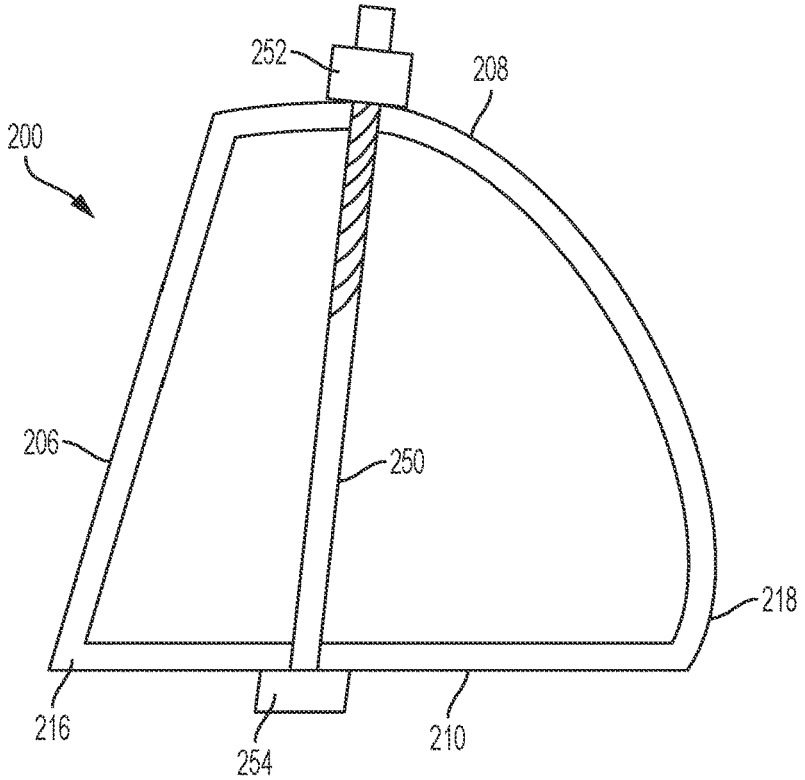
FIG. 19 is a schematic cross-sectional side view of an exemplary wood-type golf club head that includes a member extending between the crown and the sole in tension.

FIG. 19 shows an exemplary wood-type golf club head 200 having a strike plate 206, a crown 208, a sole 210, a front end 216, a rear end 218, and a stiffening member 250 held in tension between the crown and the sole. The stiffening member 250 can be secured by fasteners 252, 254 at either end that engage with the crown and sole to provide the desired tension in the stiffening member. The stiffening member 250 can comprise a bolt with threaded ends that engage with internally threaded structures at the crown and sole, such that rotating the bolt and/or the internally threaded structures increases or decreases the tension in the bolt. In other embodiments, the stiffening member 250 can be fixed to the crown or the sole and only of the fasteners 250, 252 can be rotated to adjust the tension in the member 250. In other embodiments, the stiffening member 250 is fixed relative to the crown and sole (e.g., co-molded or welded) and the tension imparted in the stiffening member during manufacturing is not adjustable. In other embodiments, the stiffening member 250 can comprise a flexible member or cord or filament having sufficient tensile strength. Tension from the tensioning member 250 urges the crown and sole toward each other to reduce the vibrational motion allowed in the crown and sole and therefore increase the vibration frequencies of the crown and sole, and thereby the entire club head 200.

Figure 20:
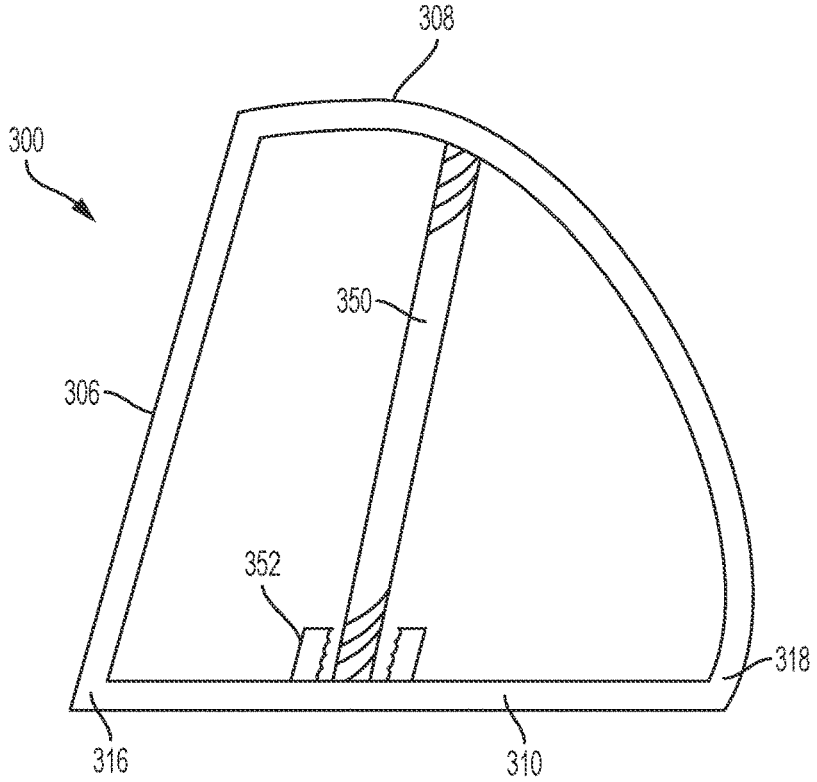
FIG. 20 is a schematic cross-sectional side view of an exemplary wood-type golf club head that includes a member extending between the crown and the sole in compression.

FIG. 20 shows an exemplary wood-type golf club head 300 having a strike plate 306, a crown 308, a sole 310, a front end 316, a rear end 318, and a stiffening member 350 held in compression between the crown and the sole. In some embodiments, the stiffening member 350 can be secured to the sole and/or the crown with fasteners, such as the illustrated internally threaded fastener 352. In some embodiments, as illustrated, one end of the member 350 can simply abut the crown or sole while the other end can be threadedly engaged with the fastener 352 such that rotating the fastener and/or the stiffening member adjusts the amount of compression in the stiffening member. In other embodiments, the stiffening member 350 is fixed relative to the crown and sole (e.g., co-molded or welded) and the compression imparted in the stiffening member during manufacturing is not adjustable. Compression in the tensioning member 350 urges the crown and sole away from each other to reduce the vibrational motion allowed in the crown and sole and therefore increase the vibration frequencies of the crown and sole, and thereby the entire club head 300.

Embodiments of the disclosed golf club heads can have a variety of different volumes. In several embodiments, a golf club head of the present application can be configured to have a head volume between about 100 $cm^3$ and about 600 $cm^3$. For example, certain embodiments of the disclosed golf club heads are for drivers and can have a club head volume from 250 $cm^3$ to 500 $cm^3$ and a club head mass of from 180 grams to 220 grams and/or from 190 grams to 200 grams. In some embodiments, the head volume is between about 300 $cm^3$ and about 500 $cm^3$, between 300 $cm^3$ and about 360 $cm^3$, between about 360 $cm^3$ and about 420 $cm^3$ or between about 420 $cm^3$ and about 500 $cm^3$. Other embodiments of the disclosed golf club heads have a volume less than 250 $cm^3$ and/or have a mass of less than 180 grams. For example, fairways and hybrid-type embodiments of the disclosed club heads can have a volume between 100 $cm^3$ and 300 $cm^3$ and/or a total mass between 80 grams and 222 grams.

Preferably, the golf club heads disclosed herein have an overall vibration frequency, i.e., the average of the first mode frequency of the crown, sole and skirt portions of the golf club head, including stiffening structures, generated upon impact with a golf ball that is greater than 2,800 Hz, greater than 3,000 Hz, greater than 3,200 Hz, greater than 3,400 Hz, greater than 3,600 Hz, greater than 3,800 Hz, and/or greater than 4,000 Hz. Frequencies in these ranges can provide a user of the golf club with an enhanced feel and satisfactory auditory feedback. However, a golf club head having a larger volume, relatively thin walls, and various combinations of weight tracks, weight ports, concavities, and/or other irregular features, can reduce the first mode vibration frequencies to undesirable levels. The addition of the stiffening structures described herein can significantly increase the first mode vibration frequencies, thus allowing the first mode frequencies to approach a more desirable level and improving the feel of the golf club to a user.

Golf Club Head Coordinates, Origin, and Center of Gravity

Figure 21:
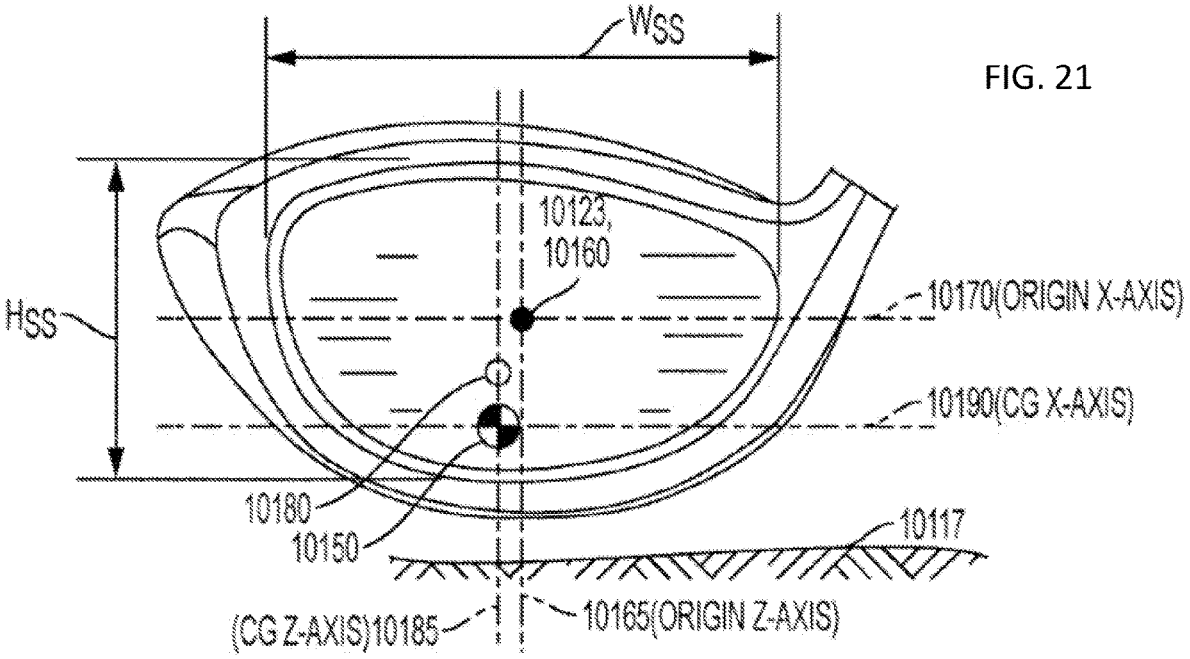
FIGS. 21-23 show front, top, and side views, respectively, of an exemplary golf club head to illustrate an exemplary coordinate system.
Figure 22:
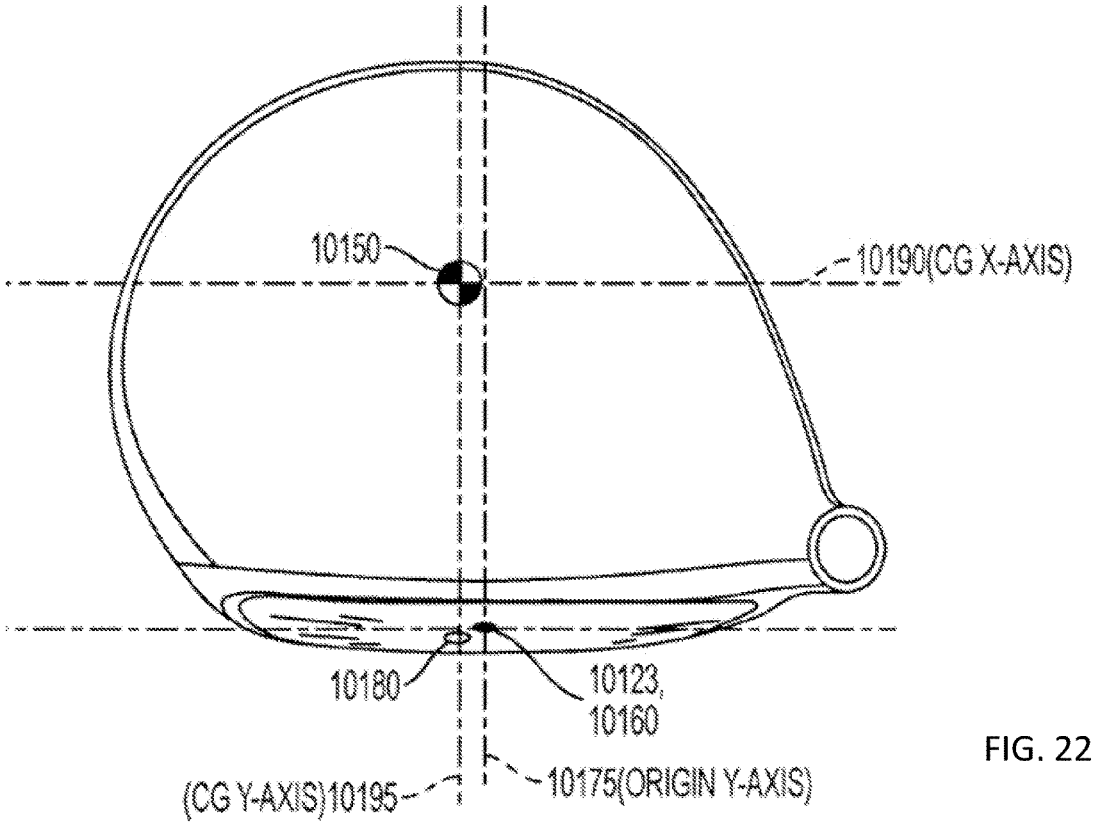
Figure 23:
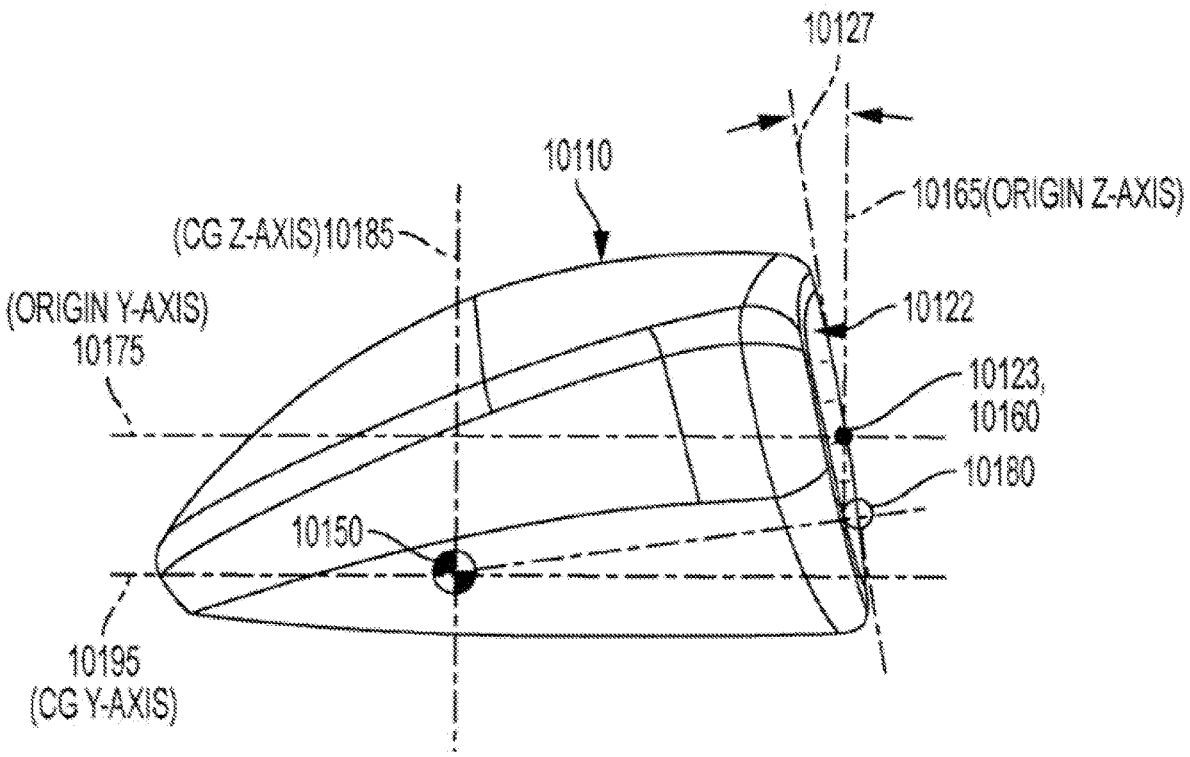

Referring to FIGS. 21-23, a club head origin coordinate system can be defined such that the location of various features of the club head (including a club head center-of-gravity (CG) 10150) can be determined. A club head origin 10160 is illustrated on the club head positioned at the center 10123 of the striking surface 10122.

The head origin coordinate system defined with respect to the head origin 10160 includes three axes: a z-axis 10165 extending through the head origin 10160 in a generally vertical direction relative to the ground 10117 when the club head 10100 is at the normal address position; an x-axis 10170 extending through the head origin 10160 in a toe-to-heel direction generally parallel to the striking surface 10122 (e.g., generally tangential to the striking surface 10122 at the center 10123) and generally perpendicular to the z-axis 10165; and a y-axis 10175 extending through the head origin 10160 in a front-to-back direction and generally perpendicular to the x-axis 10170 and to the z-axis 10165. The x-axis 10170 and the y-axis 10175 both extend in generally horizontal directions relative to the ground 10117 when the club head 10100 is at the normal address position. The x-axis 10170 extends in a positive direction from the origin 10160 towards the heel 10126 of the club head 10100. The y-axis 10175 extends in a positive direction from the head origin 10160 towards the rear portion 10132 of the club head 10100. The z-axis 10165 extends in a positive direction from the origin 10160 towards the crown.

Any golf club head features disclosed and/or claimed herein are defined with reference to the coordinate system shown in FIGS. 21-23 and described above, unless specifically stated otherwise.

Generally, the center of gravity (CG) of a golf club head is the average location of the weight of the golf club head or the point at which the entire weight of the golf club head may be considered as concentrated so that if supported at this point the head would remain in equilibrium in any position.

Referring to FIGS. 21-23, the club head CG 10150 is shown as a point inside the body 10110 of the club head 10100. The location of the club head CG 10150 can also be defined with reference to the club head origin coordinate system illustrated in FIGS. 21-23. For example, and using millimeters as the unit of measure, a CG 10150 that is located 3.2 mm from the head origin 10160 toward the toe of the club head along the x-axis, 36.7 mm from the head origin 10160 toward the rear of the club head along the y-axis, and 4.1 mm from the head origin 10160 toward the sole of the club head along the z-axis can be defined as having a $CG_x$ of −3.2 mm, a $CG_y$ of 36.7 mm, and a $CG_z$ of −4.1 mm.

As illustrated in FIGS. 21-23, an exemplary CG coordinate system defined with respect to CG 10150 includes three axes: a CG z-axis 10185 extending through the CG 10150 in a generally vertical direction relative to the ground 10117 when the club head 10100 is at the normal address position; a CG x-axis 10190 extending through the head origin 10160 in a toe-to-heel direction generally parallel to the striking surface 10122 and generally perpendicular to the CG z-axis 10185; and a CG y-axis 10195 extending through the CG 10150 in a front-to-back direction and generally perpendicular to the CG x-axis 10190 and to the CG z-axis 10185. The CG x-axis 10190 and the CG y-axis 10195 both extend in generally horizontal directions relative to the ground 10117 when the club head 10100 is at the normal address position. The CG x-axis 10190 extends in a positive direction from the CG 10150 towards the heel 10126 of the club head 10100. The CG y-axis 10195 extends in a positive direction from the CG 10150 towards the rear portion 10132 of the club head 10100. The CG z-axis 10165 extends in a positive direction from the CG 10150 towards the crown. A moment of inertia of a golf club head is measured about a CG x-axis, CG y-axis, and CG z-axis, which are axes similar to the origin coordinate system, except with an origin located at the center of gravity, CG. In certain embodiments, the golf club head of the present invention can have a moment of inertia ($I_{xx}$) about the golf club head CG x-axis between about 70 kg·mm$^2$ and about 400 kg·mm$^2$. In certain embodiments, the golf club head of the present invention can have a moment of inertia ($I_{zz}$) about the golf club head CG z-axis between about 200 kg·mm$^2$ and about 600 kg·mm$^2$. In certain embodiments, the golf club head of the present invention can have a moment of inertia ($I_{yy}$) about the golf club head CG y-axis between about 200 kg·mm$^2$ and 400 kg-mm$^2$. Embodiments having more specific ranges of values for moments of inertia ($I_{xx}$, $I_{zz}$, and $I_{yy}$) are provided herein, with reference to, e.g., Examples A-Y and Tables 2 and 3.

Referring to FIGS. 24A-24G, a weight assembly 12040 and the manner in which the weight assembly 12040 is retained on front and rear ledges 12030, 12032 within a channel 12020 are shown in more detail in FIGS. 24A-C and 24D-G. In the embodiments shown, the weight assembly 12040 includes three components: a washer 12042, a mass member 12044, and a fastening bolt 12046. The washer 12042 is located within an outer portion of the interior channel volume, engaging the outward-facing surfaces of the front ledge 12030 and rear ledge 12032. The mass member 12044 is located within an inner portion of the interior channel volume, engaging the inward-facing surfaces of the front ledge 12030 and rear ledge 12032. The fastening bolt 12046 has a threaded shaft that extends through a center aperture of the washer 12042 and engages mating threads located in a center aperture 12061 of the mass member 12044. This is a tension system for securing the weight assembly. Alternatively, the washer could have the mating threads in a center aperture, and the fastening bolt could go through a center aperture of the mass member and be tightened by a drive on the exposed outer surface of the bolt. In this embodiment, the head of the bolt would be captured on the inner surface of the mass member holding it in place during tightening.

In some embodiments, the weight assembly 12040 is installed into the channel 12020 by placing the weight assembly 12040 into an installation cavity 12038 located adjacent to the heel end 12022 of the channel 12020. The installation cavity 12038 is a portion of the channel 12020 in which the front ledge 12030 and rear ledge 12032 extend, thereby allowing for full use of the channel 12020 with substantially no unusable portions along the channel. Once placed into the installation cavity 12038, the weight assembly 12040 may be engaged with the front ledge 12030 and rear ledge 12032 or the weight assembly 12040 may be shifted to another position along the channel 12020 and then engaged with the front ledge 12030 and rear ledge 12032.

Alternatively, as shown in FIGS. 24D-G, the weight assembly 12040 may be installed into the channel 12020 by first placing the mass member 12044 into the installation cavity 12038 located adjacent to the heel end 12022 of the channel 12020, then passing the fastening bolt 12046 through the center aperture 12053 of the washer 12042 and engaging the mating threads located on the mass member 12044.

Figure 24A:
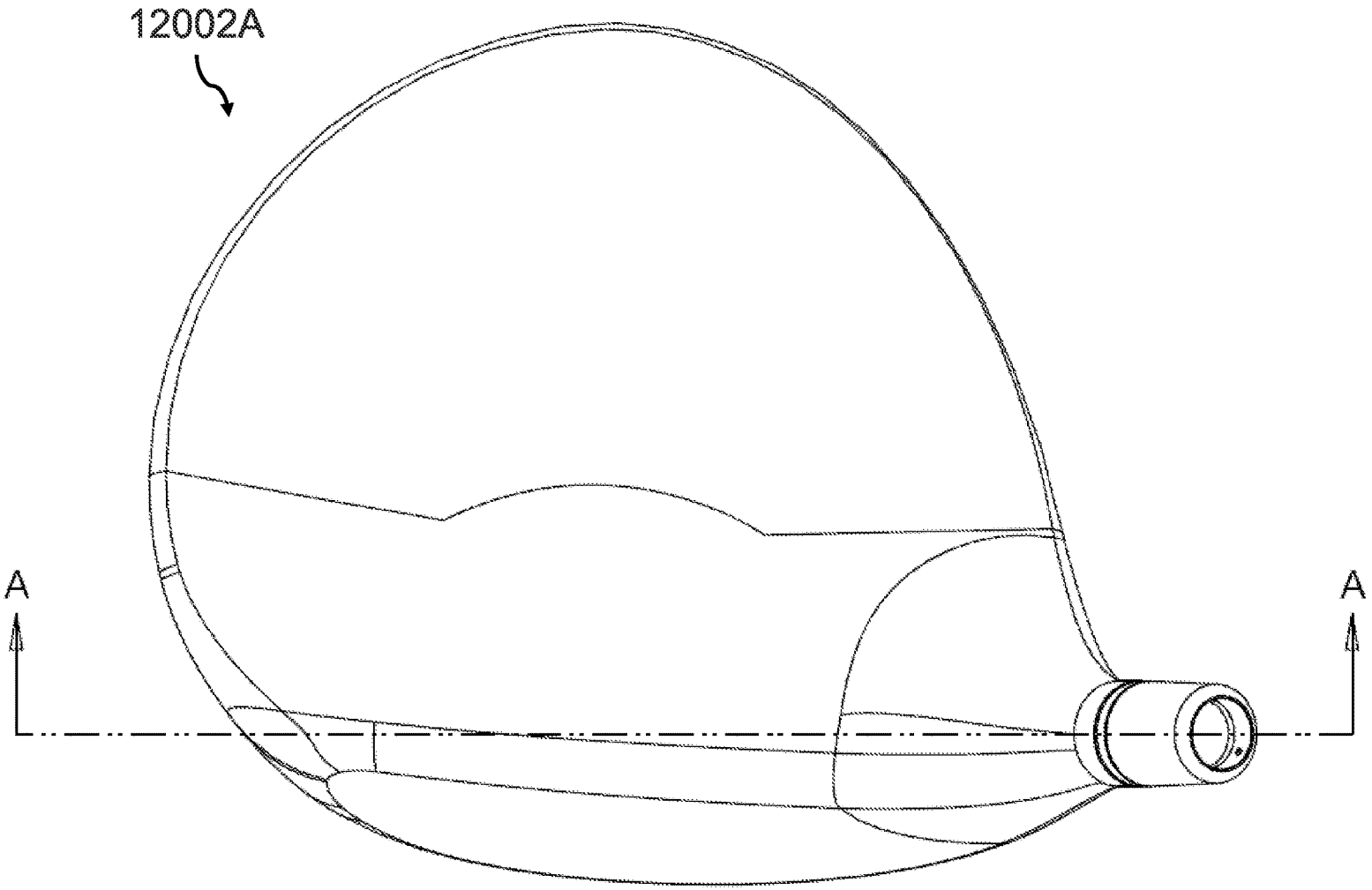
FIG. 24A is a top view of a golf club head including an adjustable shaft connection system and a recessed weight track.
Figure 24B:
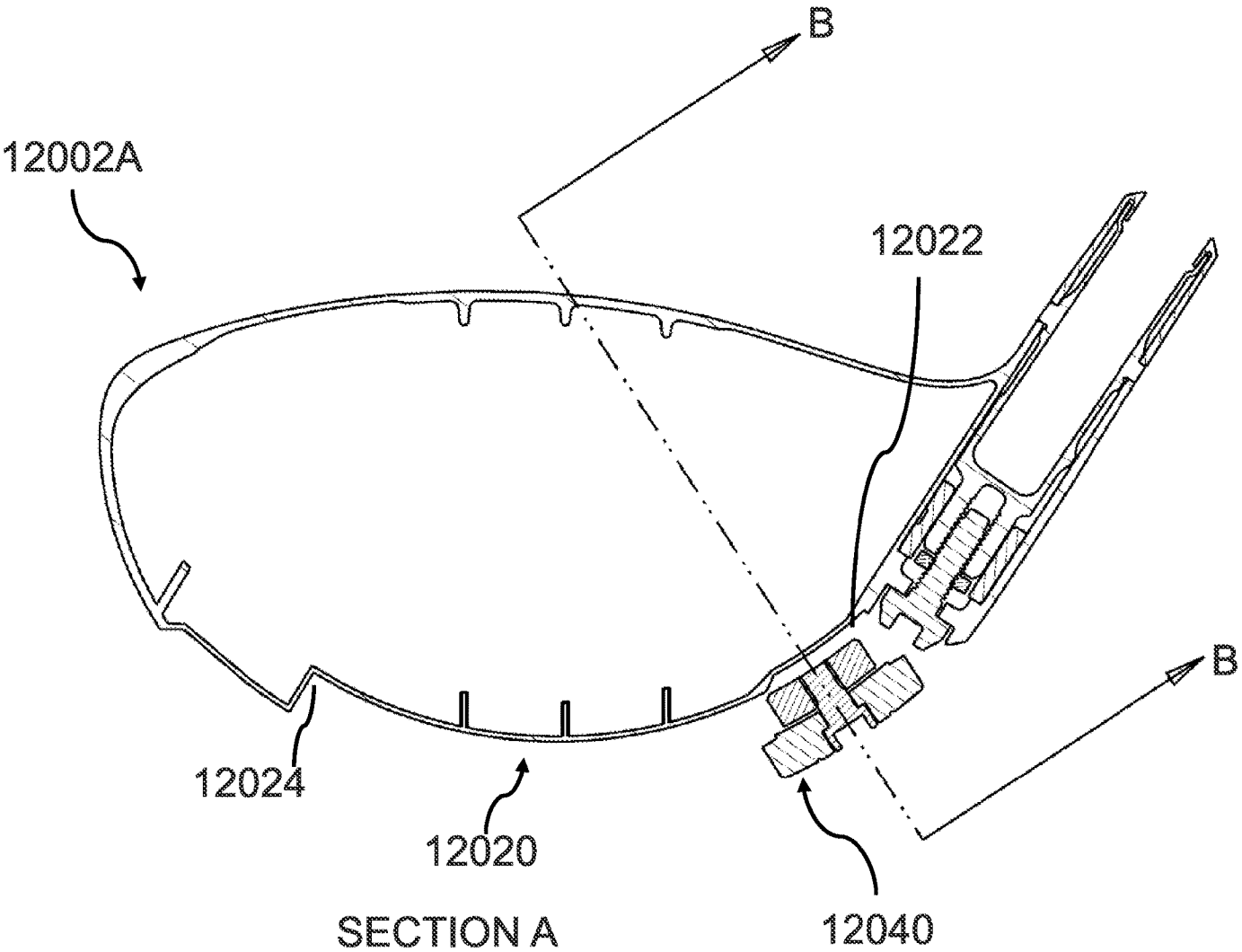
FIG. 24B is a cross-sectional view along line A-A of the golf club head of FIG. 24A.
Figure 24C:
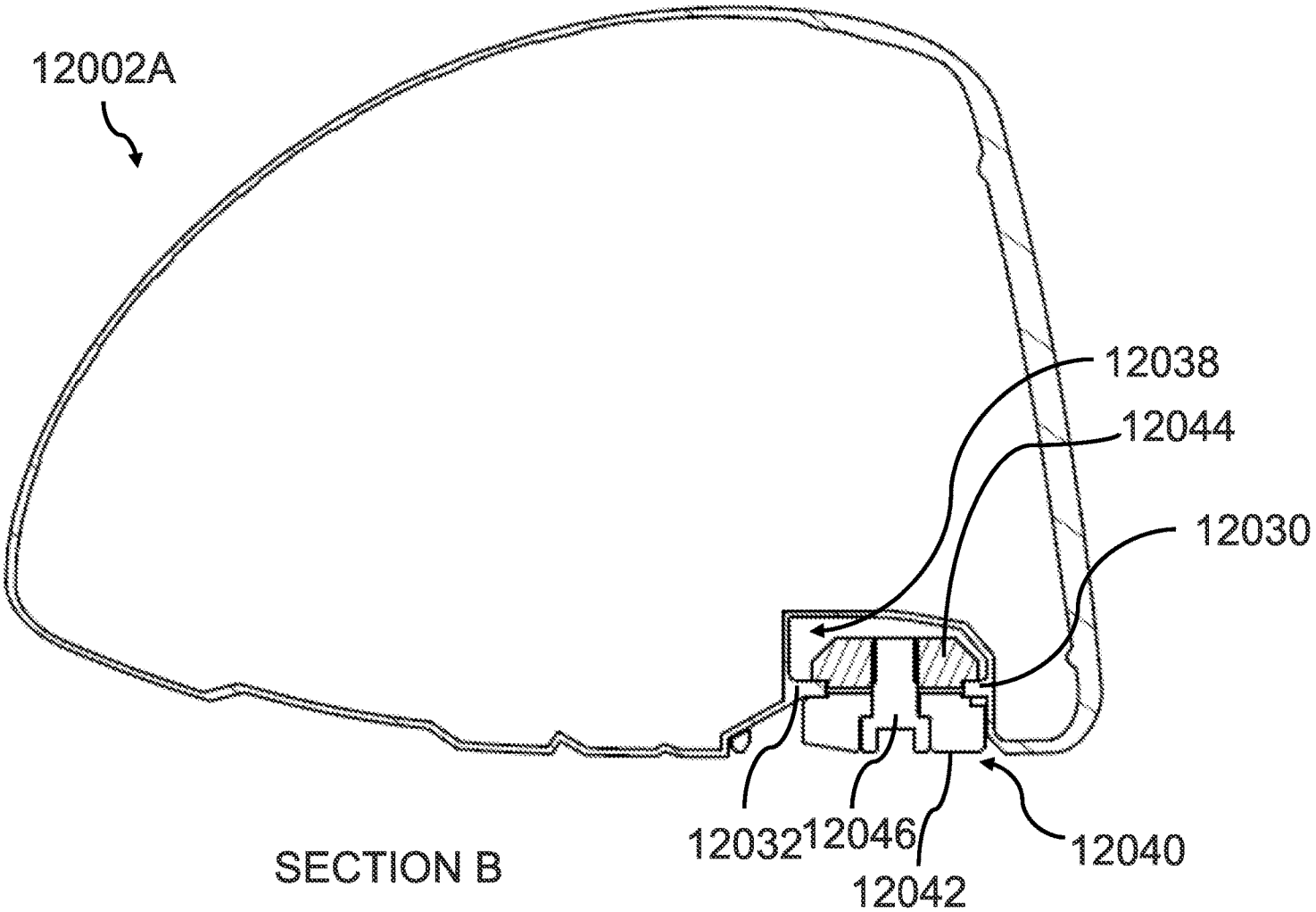
FIG. 24C is a cross-sectional view along line B-B of the golf club head of FIG. 24B.
Figure 24D:
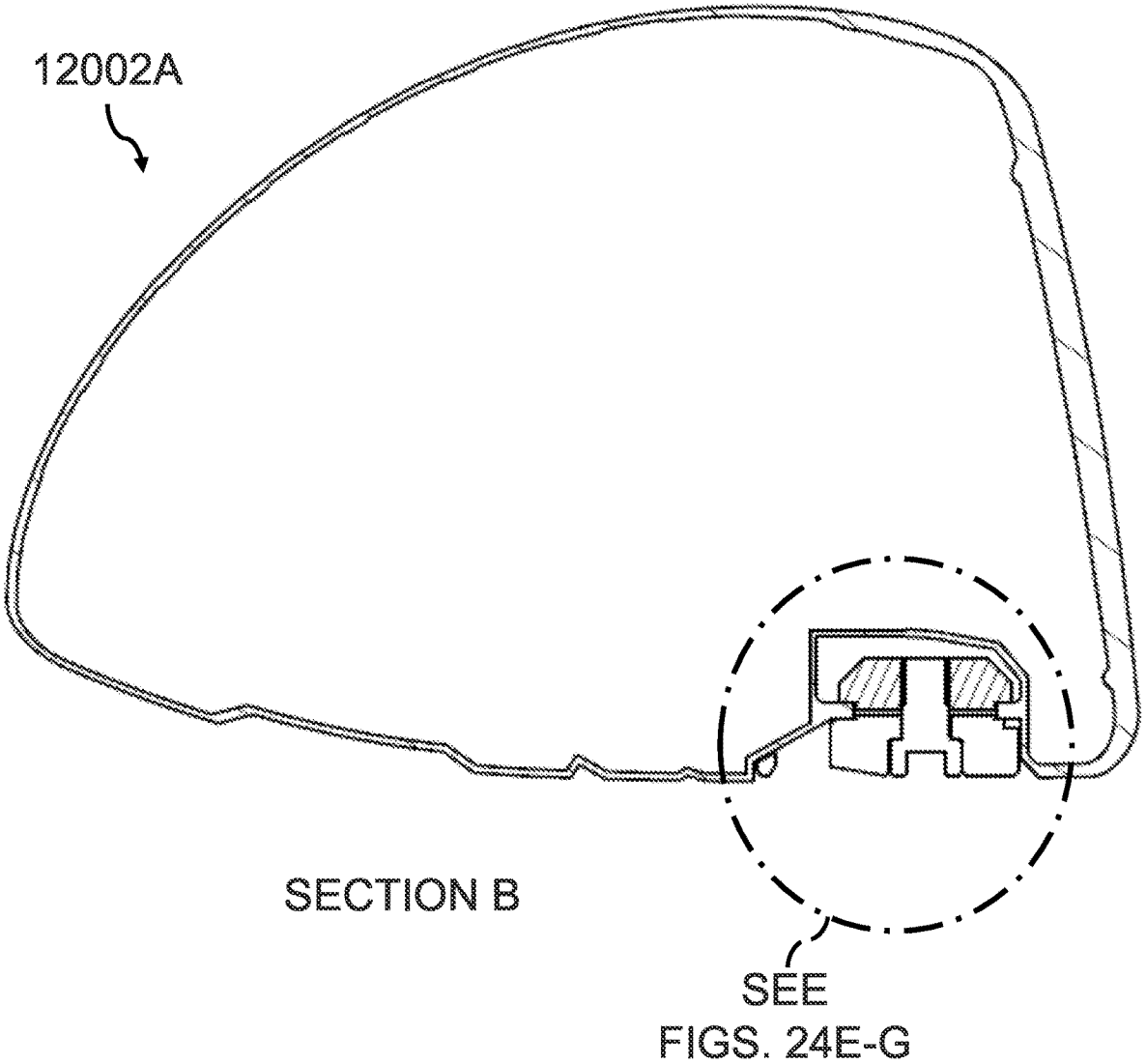
FIG. 24D is a cross-sectional view along line B-B of the golf club head of FIG. 24B.
Figure 24E:
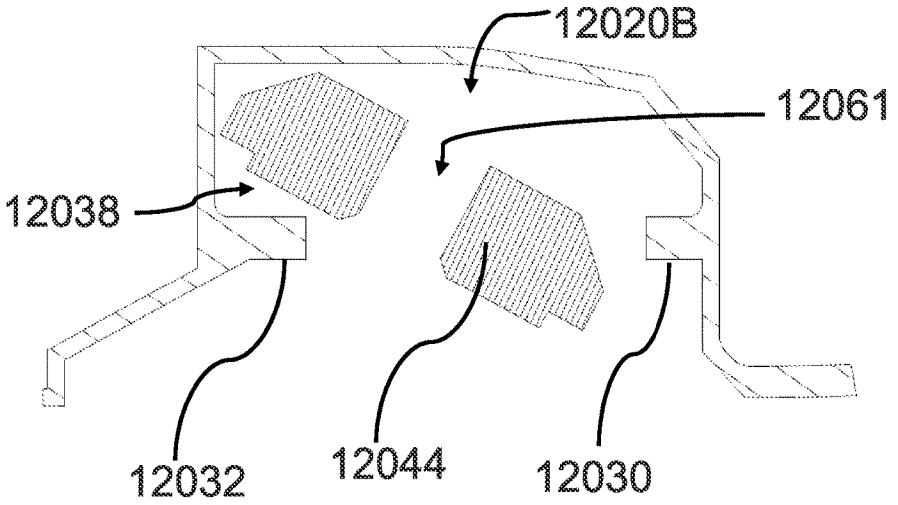
FIGS. 24E-G are close up cross-sectional views along line B-B of the golf club head of FIG. 24B with the bolt and washer of the weight assembly removed for clarity.
Figure 24G:
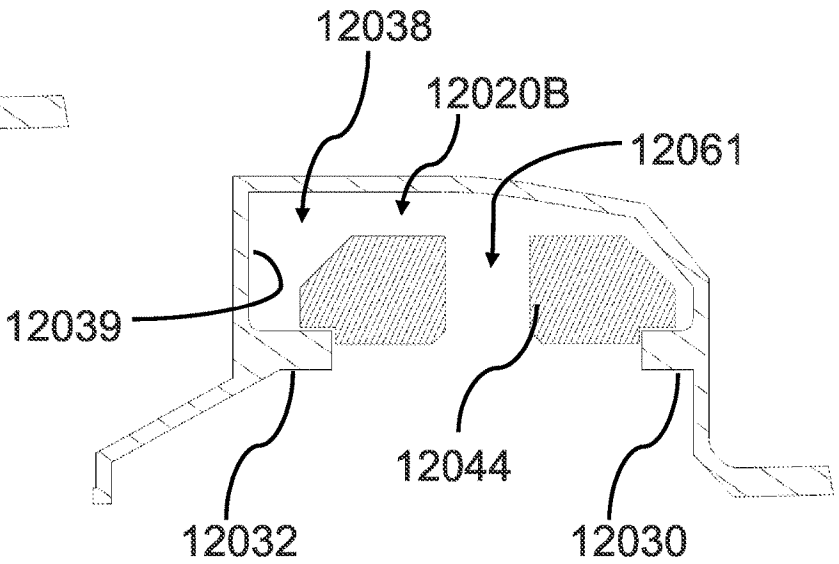
Figure 24F:
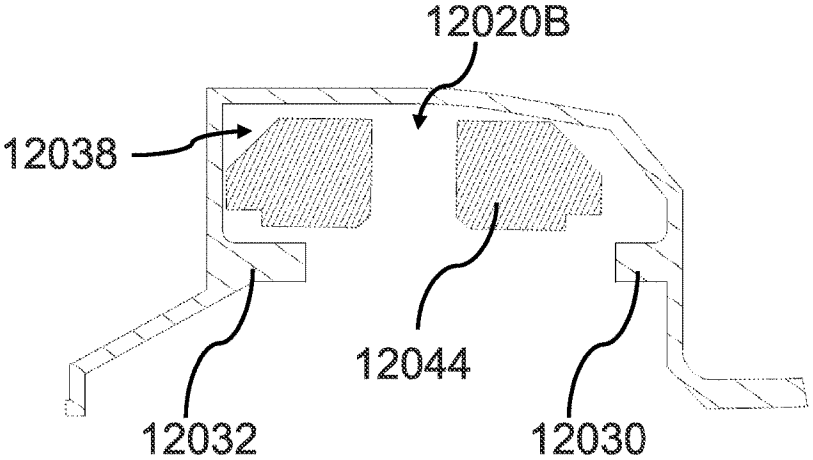

As shown in FIGS. 24D-G, placing the mass member 12044 into the installation cavity 12038 may require first angling the mass member 12044 relative to the channel (see FIG. 24E) and then inserting the mass member 12044 a sufficient distance underneath the rear ledge 12032 such that the mass member 12044 may rotate into position within the channel 12020 (see FIG. 24F). If the mass member 12044 is not inserted a sufficient distance it may not be able to rotate into position within the channel 12020 due to a possible interference with the front ledge 12030 of the channel 12020. Once the mass member is rotated into position, then the washer 12042 may be attached to the mass member 12044 using the fastening bolt 12046. FIG. 24G shows the how the mass member may transition slightly towards the front ledge when slid along the channel.

Similarly, the entire weight assembly 12040A may be installed using the same method as just described. First, the fastening bolt must loosely be holding the assembly together, next the entire assembly must be at an angle relative to the channel for insertion, then inserted into the channel such that the mass member and the washer sandwich a portion of the rear ledge, next the assembly may be rotated into position, adjusted so that the weight assembly is sandwiching both the front and rear ledges between the mass member and the washer, then the weight assembly may be slid to the desire position along the channel, and finally the fastening bolt may be tightened so as to securely engage the channel.

In some embodiments, the installation cavity 12038 may include a recessed or indented surface 12039 to facilitate installation of the mass member 12044 within the channel 12020. As shown, the recessed surface 12039 may be located between the rear ledge 12032 and the bottom channel wall 12028. Additionally or alternatively, the installation cavity 12038 and recessed surface 12039 may be located at a toe end 12024 of the channel 12020. Additionally or alternatively, the recessed surface 12039 may extend an entire length of the channel 12020 allowing for installation along the entire length of the channel. Additionally or alternatively, the recessed surface 12039 may be located between the front ledge 12030 and the bottom channel wall 12028.

EXAMPLES

The embodiments illustrated in the Figures are only exemplary and not limiting of the variety of club heads that can embodiment the technologies disclosed herein. For example, in any of the embodiments disclosed herein, the club head can include one or more traditional weight ports and corresponding removable weights, in addition to or instead of one or more weight tracks that allow a weight to slide along the track and/or one or more channels in the sole that do not mount a weight. The following are several examples of club head embodiments that can include one or more of the features disclosed herein. In any of the disclosed embodiment, a weight track may be considered to be a channel when no weight is present and/or a described weight track can be substituted with a channel in the sole that does not mount a weight in an analogous embodiment. Further details regarding these and other embodiments can be found in U.S. Patent Application Publication No. 2015/0024870 and other references referred to herein, all of which are incorporated by reference herein in their entireties.

1. Example A

According to one embodiment, a golf club head has two weight tracks and at least one weight in each weight track. The weights have a mass between about 1 gram and about 50 grams. The golf club head has a volume between about 140 $cm^3$ and about 600 $cm^3$, and a CG with a head origin y-axis coordinate greater than or equal to about 15 mm. In a specific embodiment, at least one of the weights has a head origin y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 $kg \cdot mm^2$ and about 400 $kg \cdot mm^2$, and a moment of inertia about the head CG z-axis between about 250 $kg \cdot mm^2$ and about 600 $kg \cdot mm^2$.

2. Example B

According to another embodiment, a golf club head has first and second weight tracks and at least one weight port, and corresponding weights disposed in the weight tracks and weight ports. In any of these examples, weights in a weight track can be adjustable and movable along the track. The golf club head has a volume between about 140 $cm^3$ and about 600 $cm^3$, and a CG with a head origin y-axis coordinate greater than or equal to about 15 mm. In a specific embodiment, the first and second weights each have a head origin y-axis coordinate between about 0 mm and about 130 mm. In a specific embodiment, the golf club head has a CG with a head origin x-axis coordinate between about −10 mm and about 10 mm and a y-axis coordinate between about 15 mm to about 25 mm, or between about 25 mm to about 35 mm, or between about 35 mm to about 50 mm. In a more specific embodiment, the golf club head has a moment of inertia about the head CG x-axis between about 140 $kg \cdot mm^2$ and about 400 $kg \cdot mm^2$, a moment of inertia about the head CG z-axis between about 250 $kg \cdot mm^2$ and about 600 $kg \cdot mm^2$, and a head volume greater than or equal to 250 $cm^3$.

3. Example C

According to another embodiment, a golf club head has one weight track and at least one weight for the weight track, and at least one weight port with a corresponding weight in the weight port. At least one weight has a head origin x-axis coordinate between about −40 mm and about −20 mm or between about 20 mm and about 40 mm, and a mass between about 5 grams and about 50 grams. The golf club head has a volume between about 140 $cm^3$ and about 600 $cm^3$, and a CG with a head origin y-axis coordinate greater than or equal to about 15 mm. In a specific embodiment, at least one weight has a head origin y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 $kg \cdot mm^2$ and about 400 $kg \cdot mm^2$, and a moment of inertia about the head CG z-axis between about 250 $kg \cdot mm^2$ and about 600 $kg \cdot mm^2$.

4. Example D

According to another embodiment, a golf club head has one weight track and at least one weight per weight track, and at least two weight ports with corresponding weights in the weight ports. At least one of the weights can have a head origin x-axis coordinate between about −60 mm and about −40 mm or between about 40 mm and about 60 mm, and a mass between about 5 grams and about 50 grams. The golf club head has a volume between about 140 $cm^3$ and about 600 $cm^3$, and a CG with a head origin y-axis coordinate greater than or equal to about 15 mm. In a specific embodiment, at least one weight has a y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 $kg \cdot mm^2$ and about 400 $kg \cdot mm^2$, and a moment of inertia about the head CG z-axis between about 250 $kg \cdot mm^2$ and about 600 $kg \cdot mm^2$.

5. Example E

According to another embodiment, a golf club head has first and second weight tracks and at least corresponding first and second weights disposed in the weight tracks. The golf club head has a CG with a head origin x-axis coordinate between about −3 mm and about 2 mm and a head origin y-axis coordinate between about 30 mm and about 40 mm. In a specific embodiment, the golf club head has a volume between about 140 $cm^3$ and about 500 $cm^3$, and the sum of the body mass and the total weight mass is between about 100 grams and about 240 grams. In a more specific embodiment, the golf club head has a moment of inertia about the head CG x-axis between about 220 $kg \cdot mm^2$ and about 360 $kg \cdot mm^2$ and a moment of inertia about the head CG z-axis between about 360 $kg \cdot mm^2$ and about 500 $kg \cdot mm^2$.

6. Example F

According to another embodiment, a golf club head has at least two weight tracks and/or weight ports (any combination thereof) and at least corresponding first and second weights disposed in the weight tracks/weight ports. The golf club head can have a CG with a head origin x-axis coordinate between about 2 mm and about 6 mm and a head origin y-axis coordinate between about 30 mm and about 40 mm. In a specific embodiment, the golf club head has a volume between about 100 $cm^3$ and about 600 $cm^3$, and the sum of the body mass and the total weight mass is between about 100 grams and about 245 grams. In a more specific embodiment, the golf club head has a moment of inertia about the head CG x-axis between about 220 $kg \cdot mm^2$ and about 360 $kg \cdot mm^2$ and a moment of inertia about the head CG z-axis between about 360 $kg \cdot mm^2$ and about 500 $kg \cdot mm^2$.

7. Example G

According to another embodiment, a golf club head has first and second weight tracks and/or weight ports and at least corresponding first and second weights disposed in the weight tracks/ports. The golf club head can have a CG with a head origin x-axis coordinate between about −2 mm and about 1 mm and a head origin y-axis coordinate between about 31 mm and about 37 mm. In a specific embodiment, the golf club head has a volume between about 240 $cm^3$ and about 460 $cm^3$, and the sum of the body mass and the total weight mass is between about 180 grams and about 215 grams. In a more specific embodiment, the golf club head has a moment of inertia about the head CG x-axis between about 220 kg·mm$^2$ and about 280 kg·mm$^2$ and a moment of inertia about the head CG z-axis between about 360 kg·mm$^2$ and about 450 kg·mm$^2$.

8. Example H

According to another embodiment, a golf club head has first and second weight tracks and/or weight ports and at least corresponding first and second weights disposed in the tracks/ports. The golf club head has a CG with a head origin x-axis coordinate between about 2 mm and about 5 mm and a head origin y-axis coordinate between about 31 mm and about 37 mm. In a specific embodiment, the golf club head has a volume between about 440 cm$^3$ and about 460 cm$^3$, and the sum of the body mass and the total weight mass is between about 180 grams and about 215 grams. In a more specific embodiment, the golf club head has a moment of inertia about the head CG x-axis between about 220 kg·mm$^2$ and about 280 kg·mm$^2$ and a moment of inertia about the head CG z-axis between about 360 kg·mm$^2$ and about 450 kg·mm$^2$.

9. Example I

According to another embodiment, a golf club head has first and second weight tracks and/or weight ports and corresponding first and second weights disposed in the tracks/ports. The golf club head has a CG with a head origin x-axis coordinate between about −4 mm and about 4 mm and a head origin y-axis coordinate between about 20 mm and about 30 mm. In a specific embodiment, the golf club head has a volume between about 100 cm$^3$ and about 250 cm$^3$, a loft between about 13 degrees and about 30 degrees, and the sum of the body mass and the total weight mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

10. Example J

According to another embodiment, a golf club head has first and second weight tracks and/or weight ports and corresponding weights disposed in the tracks. The golf club head has a CG with a head origin x-axis coordinate between about −2 mm and about 6 mm and a head origin y-axis coordinate between about 20 mm and about 30 mm. In a specific embodiment, the golf club head has a volume between about 100 cm$^3$ and about 210 cm$^3$, a loft between about 13 degrees and about 30 degrees, and the sum of the body mass and the total weight mass is between about 180 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

11. Example K

According to another embodiment, a golf club head has first and second weight tracks and/or weight ports and corresponding weights disposed in the tracks/ports. The golf club head has a CG with a head origin x-axis coordinate between about −4 mm and about 4 mm and a head origin y-axis coordinate between about 20 mm and about 30 mm. In a specific embodiment, the golf club head has a volume between about 100 cm$^3$ and about 250 cm$^3$, a loft between about 13 degrees and about 30 degrees, and the sum of the body mass and the total weight mass is between about 178 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

12. Example L

According to another embodiment, a golf club head has first and second weight tracks and/or weight ports and corresponding weights disposed in the tracks/ports, and at least one weight port and corresponding weight. A first weight has a head origin x-axis coordinate between about −40 mm and about −20 mm, a head origin y-axis coordinate between about 20 mm and about 40 mm, and a mass. The golf club head has a CG with a head origin x-axis coordinate between about −2 mm and about 6 mm and a head origin y-axis coordinate between about 20 mm and about 30 mm. In a specific embodiment, the golf club head has a volume between about 100 cm$^3$ and about 230 cm$^3$, a loft between about 13 degrees and about 30 degrees, and the sum of the body mass and the total port mass is between about 178 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

13. Example M

According to another embodiment, a golf club head has first, second, and third weight tracks and/or weight ports and corresponding weights disposed in the tracks/ports. The golf club head has a CG with a head origin x-axis coordinate between about −1 mm and about 4 mm and a head origin y-axis coordinate between about 23 mm and about 40 mm. In a specific embodiment, the golf club head has a volume between about 360 cm$^3$ and about 600 cm$^3$ and the sum of the body mass and the total weight mass is between about 181 grams and about 231 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

14. Example N

According to another embodiment, a golf club head has first, second, and third weight tracks and/or weight ports and corresponding weights disposed in the tracks/ports. The golf club head has a CG with a head origin x-axis coordinate between about −1 mm and about 4 mm and a head origin y-axis coordinate between about 20 mm and about 37 mm. In a specific embodiment, the golf club head has a volume between about 360 cm$^3$ and about 500 cm$^3$ and the sum of the body mass and the total weight mass is between about 171 grams and about 231 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

15. Example O

According to another embodiment, a golf club head has first, second, and third weight tracks and/or weight ports and corresponding weights disposed in the tracks/ports. The golf club head has a CG with a head origin x-axis coordinate between about −3 mm and about 3 mm and a head origin y-axis coordinate between about 20 mm and about 38 mm. In a specific embodiment, the golf club head has a volume between about 360 cm$^3$ and about 500 cm$^3$ and the sum of the body mass and the total weight mass is between about 181 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

16. Example P

According to another embodiment, a golf club head has first, second, and third weight tracks and/or weight ports and corresponding weights disposed in the tracks/ports. The golf club head has a CG with a head origin x-axis coordinate between about 0 mm and about 6 mm and a head origin y-axis coordinate between about 22 mm and about 38 mm. In a specific embodiment, the golf club head has a volume between about 360 cm$^3$ and about 460 cm$^3$ and the sum of the body mass and the total weight mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

17. Example Q

According to another embodiment, a golf club head has first, second, and third weight tracks and/or weight ports and corresponding weights disposed in the tracks/ports. The golf club head has a CG with a head origin x-axis coordinate between about 0 mm and about 6 mm and a head origin y-axis coordinate between about 20 mm and about 38 mm. In a specific embodiment, the golf club head has a volume between about 360 cm$^3$ and about 460 cm$^3$ and the sum of the body mass and the total weight mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

18. Example R

According to another embodiment, a golf club head has first, second, and third weight tracks and/or ports and corresponding weights disposed in the tracks/ports. The golf club head has a CG with a head origin x-axis coordinate between about −3 mm and about 3 mm and a head origin y-axis coordinate between about 22 mm and about 38 mm. In a specific embodiment, the golf club head has a volume between about 360 cm$^3$ and about 460 cm$^3$ and the sum of the body mass and the total weight mass is between about 180 grams and about 221 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

19. Example S

According to another embodiment, a golf club head has first, second, third, and fourth weight tracks and/or weight ports and corresponding weights disposed in the tracks/ports. The golf club head can have a CG with a head origin x-axis coordinate between about −1 mm and about 4 mm and a head origin y-axis coordinate between about 23 mm and about 40 mm. In a specific embodiment, the golf club head has a volume between about 140 cm$^3$ and about 600 cm$^3$ and the sum of the body mass and the total weight mass is between about 100 grams and about 250 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

20. Example T

According to another embodiment, a golf club head has first, second, third, and fourth weight tracks and/or weight ports and corresponding weights disposed in the tracks/ports. The golf club head has a CG with a head origin x-axis coordinate between about −1 mm and about 4 mm and a head origin y-axis coordinate between about 20 mm and about 37 mm. In a specific embodiment, the golf club head has a volume between about 360 cm$^3$ and about 500 cm$^3$ and the sum of the body mass and the total weight mass is between about 171 grams and about 231 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

21. Example U

According to another embodiment, a golf club head has first, second, third, and fourth weight tracks and/or weight ports and corresponding weights disposed in the tracks/ports. The golf club head has a CG with a head origin x-axis coordinate between about −3 mm and about 3 mm and a head origin y-axis coordinate between about 22 mm and about 38 mm. In a specific embodiment, the golf club head has a volume between about 360 cm$^3$ and about 500 cm$^3$ and the sum of the body mass and the total port mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

22. Example V

According to another embodiment, a golf club head has first, second, third, and fourth weight ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 8 mm and about 28 mm, a head origin y-axis coordinate between about 63 mm and about 83 mm, and a mass between about 6 grams and about 18 grams. The fourth weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about 0 mm and about 6 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

23. Example W

According to another embodiment, a golf club head has a front channel and a rear weight track and at least one weight port, and corresponding weights disposed in the weight tracks and weight ports. In any of these examples, weights in a weight track can be adjustable and movable along the track. The golf club head has a volume between about 140 $cm^3$ and about 600 $cm^3$, and a CG with a head origin y-axis coordinate greater than or equal to about 15 mm. In a specific embodiment, the first and second weights each have a head origin y-axis coordinate between about 0 mm and about 130 mm. In a specific embodiment, the golf club head has a CG with a head origin x-axis coordinate between about −10 mm and about 10 mm and a y-axis coordinate between about 15 mm to about 25 mm, or between about 25 mm to about 35 mm, or between about 35 mm to about 50 mm. In a more specific embodiment, the golf club head has a moment of inertia about the head CG x-axis between about 140 $kg \cdot mm^2$ and about 400 $kg \cdot mm^2$, a moment of inertia about the head CG z-axis between about 250 $kg \cdot mm^2$ and about 600 $kg \cdot mm^2$, and a head volume greater than or equal to 250 $cm^3$.

24. Example X

Table 2 below provides mass properties for an embodiment of the club head 2 shown in FIGS. 1-10 having two sliding weight tracks. The mass properties in the column "Center-Front" are for when the two weights 32, 34 in the front weight track 30 are in the center of the track (as shown in FIG. 2) and the weight 38 in the rear track 36 is at the front end of the track. The mass properties in the column "Split-Back" are for when the two weights 32, 34 are at the toe and heel ends of the track 30 and the weight 38 is at the rear end of the track 36. As shown in Table 2, the moment of inertia about the z-axis Izz of the club head can be significantly adjusted (more than 10%) by moving the adjustable weights 32, 34, 38. Several other mass characteristics of the club head can similarly be adjusted by adjusting one or more of the weights. For example, repositioning the two weights 32, 34 in the front weight track 30 from the toe side 12 to the heel side 14 moves the head origin x-axis coordinate between about −3 mm and about 3 mm, moves the head origin y-axis coordinate between about 0 mm and about 0.5 mm, and moves the head origin z-axis coordinate between about 0 mm and about 0.7 mm. The table values below should be understood to include conventional units, such as those used elsewhere herein or in the incorporated references.

TABLE 2

| | Configuration: | |
|---|---|---|
| MASS PROPERTIES | Center-Front | Split-Back |
| TOTAL MASS (w/snot): | 207.1 | 207.1 |
| VOLUME: | 429 | 429 |
| ADDRESS AREA: | 11931 | 11931 |
| CGX: | 0.4 | 0.5 |
| CGY: | 28.0 | 31.0 |
| CGZ: | −4.4 | −3.9 |
| Z UP: | 25.4 | 26.0 |
| ASM DELTA-1: | 13.1 | 15.3 |
| ASM DELTA-2: | 33.8 | 34.0 |
| ASM DELTA-3: | 73.8 | 73.3 |
| I1: | 220 | 242 |
| I2: | 304 | 317 |
| I3: | 400 | 445 |
| Ixx: | 237 | 265 |
| Iyy: | 288 | 298 |
| Izz: | 398 | 442 |
| I HOSEL AXIS: | 624 | 678 |
| PATENT Ixx MIN: | 275 | 275 |
| CG ANGLE: | 21.2 | 24.2 |

25. Example Y

Table 3 below provides ranges for mass properties for embodiments of the club head 100 shown in FIGS. 11-18. Many of the listed mass properties can be adjusted by adjusting the position of the weight 128 and/or by exchanging the weight 128 for another weight having a different mass or weight distribution.

TABLE 3

| MASS PROPERTIES: | |
|---|---|
| TOTAL MASS (w/snot): | 180-220 |
| VOLUME: | 300-500 |
| ADDRESS AREA: | 11,000-13,000 |
| CGX: | 1.4-1.8 |
| CGY: | 28.0-31.0 |
| CGZ: | −1.5 to −1.9 |
| Z UP: | 26-30 |
| ASM DELTA-1: | 12-14 |
| ASM DELTA-2: | 36-40 |
| ASM DELTA-3: | 70-78 |
| I1: | 200-240 |
| I2: | 280-320 |
| I3: | 280-320 |
| Ixx: | 220-250 |
| Iyy: | 260-320 |
| Izz: | 360-500 |
| I HOSEL AXIS: | 666 |
| PATENT Ixx MIN: | 270.0 |
| CG ANGLE: | 19.1 |

Having illustrated and described the principles of the illustrated embodiments, it will be apparent to those skilled in the art that the embodiments can be modified in arrangement and detail without departing from such principles. Embodiments having any combination of the features, elements, and characteristics disclosed herein, and/or disclosed in the references that are incorporated herein by reference, are included as part of this disclosure.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope of the following claims.

The invention claimed is:

1. A golf club head comprising:

a body having a face, a crown, and a sole together defining an interior cavity, the crown comprising a composite material;

at least one weight assembly; and a channel located below the crown comprising first and second opposing ledges extending within the channel, the channel adapted to receive the at least one weight assembly such that a position of the at least one weight assembly along the channel is adjustable; and wherein the first ledge has a first outer ledge surface and a first inner ledge surface opposite the first outer ledge surface, and the second ledge has a second outer ledge surface and a second inner ledge surface opposite the second outer ledge surface;

wherein the at least one weight assembly is configured to clamp the first and second ledges at selected locations along the channel;

wherein the at least one weight assembly is located entirely external to the interior cavity of the body and comprises an inner member, and an outer member attached to the inner member using a fastening bolt, wherein the at least one weight assembly is configured to be adjusted so that the weight assembly sandwiches the first and second ledges between the inner member and the outer member;

wherein both the outer member and the inner member are non-circular; wherein the channel is recessed, the first and second ledges are located within a recessed portion of the channel, and the weight assembly including the outer member and the inner member sit within the recessed portion of the channel;

wherein the channel comprises a weight installation cavity that is located at a position within the channel where the at least one weight assembly is configured to clamp;

wherein the weight installation cavity is configured to allow angled insertion of at least the inner member within the channel; and wherein the outer member contacts the first outer ledge surface and the second outer ledge surface.

2. The golf club head of claim 1, wherein the club head has a moment of inertia about a cg y-axis (Iyy) between 260-320 $kg \cdot mm^2$.

3. The golf club head of claim 2, further comprising:

a heel opening located on a heel end of the body, the heel opening configured to receive a fastening member; and a head-shaft connection system including a sleeve that is secured by the fastening member in a locked position, the head-shaft connection system configured to allow the golf club head to be adjustably attachable to a golf club shaft in a plurality of different positions resulting in an adjustability range of different combinations of loft angle, face angle, or lie angle.

4. The golf club head of claim 3, wherein the heel opening is surrounded by a recessed sole portion and the recessed sole portion has a non-circular outer perimeter portion.

5. The golf club head of claim 3, further comprising a weight port formed in a portion of the golf club head and adapted to receive a weight, and one or more ribs connecting to the weight port and the interior cavity.

6. The golf club head of claim 3, wherein the channel is curved and the channel extends generally in a heel-toe direction, and the at least one weight assembly is adjustable along the channel in the heel-toe direction.

7. The golf club head of claim 6, wherein the outer member comprises a central protrusion that extends into a space between the first and second ledges.

8. The golf club head of claim 2, further comprising a stiffening structure positioned within the interior cavity at a location spaced between the face and a rear end of the body and spaced between a toe side of the body and a heel side of the body, the stiffening structure comprising an elongated member having a lower end coupled to the sole, an upper end coupled to the crown, and an intermediate portion between the lower end and the upper end that is positioned within the interior cavity apart from the body; and wherein the stiffening structure is at least partially solid.

9. The golf club head of claim 8, wherein a lower portion of the stiffening structure is positioned closer to a front end of the golf club head than a rear end of the golf club head.

10. The golf club head of claim 9, wherein the stiffening structure is co-molded with at least a portion of the body.

11. The golf club head of claim 9, wherein in at least one cross-section through the stiffening structure, the stiffening structure has a first dimension between 2 mm and 7 mm, and the first dimension is greater than a thickness of the stiffening structure.

12. The golf club head of claim 9, wherein at least a portion of the stiffening structure is positioned on the toe side of the body toeward of a center of the face.

13. The golf club head of claim 12, wherein the at least a portion of the stiffening structure positioned on the toe side of the body has a mass that is 8 grams or less.

14. The golf club head of claim 9, further comprising an adjustable head-shaft attachment system configurable to selectively adjust an orientation of the golf club head relative to a golf club shaft.

15. The golf club head of claim 14, wherein the crown comprises:

an outer crown surface and an inner crown surface; and a crown height measured relative to the outer crown surface and a ground plane when the golf club head is in a normal address position, wherein:

there is a first crown height at a face-to-crown transition region in a forward crown area where the face connects to the crown of the golf club head, a second crown height at a crown-to-skirt transition region where the crown connects to a skirt of the golf club head near a rear end of the golf club head, and a maximum crown height is located rearward of the first crown height and forward of the second crown height; and the maximum crown height is greater than both the first and second crown heights.

16. The golf club head of claim 14, wherein:

the golf club head has a crown height as measured relative to a ground plane when the club head is in a normal address position, there is a first crown height at a face-to-crown transition region where the face connects to the crown of the club head near a front end of the golf club head, a second crown height at a crown-to-skirt transition region where the crown connects to a skirt of the golf club head near a rear end of the golf club head, and a maximum crown height is located on the crown insert rearward of the first crown height and forward of the second crown height, and the maximum crown height is greater than both the first and second crown heights.

17. A golf club head comprising:

a body having a face, a crown, and a sole together defining an interior cavity, the crown comprising a composite material;

at least one weight assembly; and a channel located below the crown comprising first and second opposing ledges extending within the channel, the channel adapted to receive the at least one weight assembly such that a position of the at least one weight assembly along the channel is adjustable;

wherein the first ledge has a first outer ledge surface and a first inner ledge surface opposite the first outer ledge surface, and the second ledge has a second outer ledge surface and a second inner ledge surface opposite the second outer ledge surface;

wherein the at least one weight assembly is configured to clamp the first and second ledges at selected locations along the channel;

wherein the at least one weight assembly is located entirely external to the interior cavity of the body and comprises an inner member, and an outer member attached to the inner member using a fastening bolt, wherein the at least one weight assembly is configured to be adjusted so that the weight assembly sandwiches the first and second ledges between the inner member and the outer member;

wherein both the outer member and the inner member are non-circular;

wherein the channel is recessed, the first and second ledges are located within a recessed portion of the channel, and the weight assembly including the outer member and the inner member sit within the recessed portion of the channel;

wherein the channel comprises a weight installation cavity that is located at a position within the channel where the at least one weight assembly is configured to clamp;

wherein the weight installation cavity is configured to allow angled insertion of at least the inner member within the channel; and wherein the outer member contacts the first outer ledge surface and the second outer ledge surface; and the golf club head further comprising:

a heel opening located on a heel end of the body, the heel opening configured to receive a fastening member; and a head-shaft connection system including a sleeve that is secured by the fastening member in a locked position, the head-shaft connection system configured to allow the golf club head to be adjustably attachable to a golf club shaft in a plurality of different positions resulting in an adjustability range of different combinations of loft angle, face angle, or lie angle.

18. The golf club head of claim 17, wherein the club head has a moment of inertia about a cg y-axis (Iyy) between 260-320 kg·mm$^2$.

19. The golf club head of claim 18, wherein the crown comprises:

an outer crown surface and an inner crown surface; and a crown height measured relative to the outer crown surface and a ground plane when the golf club head is in a normal address position, wherein:

there is a first crown height at a face-to-crown transition region in a forward crown area where the face connects to the crown of the golf club head, a second crown height at a crown-to-skirt transition region where the crown connects to a skirt of the golf club head near a rear end of the golf club head, and a maximum crown height is located rearward of the first crown height and forward of the second crown height; and the maximum crown height is greater than both the first and second crown heights.

20. The golf club head of claim 18, wherein:

the golf club head has a crown height as measured relative to a ground plane when the club head is in a normal address position, there is a first crown height at a face-to-crown transition region where the face connects to the crown of the club head near a front end of the golf club head, a second crown height at a crown-to-skirt transition region where the crown connects to a skirt of the golf club head near a rear end of the golf club head, and a maximum crown height is located on the crown insert rearward of the first crown height and forward of the second crown height, and the maximum crown height is greater than both the first and second crown heights.

21. A golf club head comprising:

a body having a face, a crown, and a sole together defining an interior cavity, the crown comprising a composite material;

at least one weight assembly;

a channel located below the crown comprising first and second opposing ledges extending within the channel, the channel adapted to receive the at least one weight assembly such that a position of the at least one weight assembly along the channel is adjustable; and wherein the first ledge has a first outer ledge surface and a first inner ledge surface opposite the first outer ledge surface, and the second ledge has a second outer ledge surface and a second inner ledge surface opposite the second outer ledge surface; and a stiffening structure positioned within the interior cavity at a location spaced between the face and a rear end of the body and spaced between a toe side of the body and a heel side of the body, the stiffening structure comprising a lower end coupled to the sole, an upper end coupled to the crown, and an intermediate portion between the lower end and the upper end that is positioned within the interior cavity apart from the body;

wherein:

the at least one weight assembly is configured to clamp the first and second ledges at selected locations along the channel;

the at least one weight assembly is located entirely external to the interior cavity of the body and comprises an inner member, and an outer member attached to the inner member using a fastening bolt, wherein the at least one weight assembly is configured to be adjusted so that the weight assembly sandwiches the first and second ledges between the inner member and the outer member;

both the outer member and the inner member are non-circular;

wherein the channel is recessed, the first and second ledges are located within a recessed portion of the channel, and the weight assembly including the outer member and the inner member sit within the recessed portion of the channel;

the channel comprises a weight installation cavity that is located within a portion of the channel where the at least one weight assembly is configured to clamp;

the weight installation cavity is configured to allow angled insertion of at least the inner member within the channel;

the outer member contacts the first outer ledge surface and the second outer ledge surface;

the club head has a moment of inertia about a cg y-axis (Iyy) between 260-320 $kg \cdot mm^2$; and at least a portion of the stiffening structure has a thickness between 0.25 mm and 2.5 mm.

* * * * *